US007475958B2

(12) United States Patent
Maki

(10) Patent No.: US 7,475,958 B2
(45) Date of Patent: Jan. 13, 2009

(54) IMAGE FORMING DEVICE

(75) Inventor: Tsuneo Maki, Kanagawa (JP)

(73) Assignee: Ricoh Company, Ltd, Tokyo (JP)

( * ) Notice: Subject to any disclaimer, the term of this patent is extended or adjusted under 35 U.S.C. 154(b) by 0 days.

(21) Appl. No.: 11/795,367

(22) PCT Filed: Feb. 22, 2006

(86) PCT No.: PCT/JP2006/303813

§ 371 (c)(1),
(2), (4) Date: Jul. 16, 2007

(87) PCT Pub. No.: WO2006/090883

PCT Pub. Date: Aug. 31, 2006

(65) Prior Publication Data

US 2008/0150993 A1 Jun. 26, 2008

(30) Foreign Application Priority Data

Feb. 23, 2005 (JP) ..... 2005-046497
Dec. 20, 2005 (JP) ..... 2005-366024

(51) Int. Cl.
*B41J 29/38* (2006.01)

(52) U.S. Cl. ..... 347/14; 347/41; 347/19

(58) Field of Classification Search ..... 347/12, 347/14, 15, 19, 41, 101–105
See application file for complete search history.

(56) References Cited

U.S. PATENT DOCUMENTS 5,619,234 A * 4/1997 Nagato et al. ..... 347/55
5,633,663 A * 5/1997 Matsubara et al. ..... 347/41
6,106,093 A 8/2000 Nagoshi et al.
6,460,969 B1 * 10/2002 Pinkernell ..... 347/43
6,682,185 B2 1/2004 Hashimoto et al.
6,786,590 B2 9/2004 Maki et al.
6,913,348 B2 7/2005 Hashimoto et al.
2004/0263603 A1 12/2004 Maki et al.

FOREIGN PATENT DOCUMENTS

| | | |
|---|---|---|
| JP | 8-11298 | 1/1996 |
| JP | 10-152248 | 6/1998 |
| JP | 2000-127368 | 5/2000 |
| JP | 2003-11458 | 1/2003 |
| JP | 2004-122681 | 4/2004 |
| JP | 2004-122685 | 4/2004 |
| JP | 2004-291654 | 10/2004 |

* cited by examiner

*Primary Examiner*—Lammson D Nguyen
(74) *Attorney, Agent, or Firm*—Cooper & Dunham, LLP

(57) ABSTRACT

An image forming device comprises a carriage on which a printing head is carried, a plurality of nozzles each discharging a droplet of printing liquid being arrayed in the printing head. A main scanning of the carriage to a sheet is performed and the sheet is fed intermittently so that an image is formed on the sheet. When a continuous printing of images to sheets is performed and quality of an image formed on a following sheet is the same as quality of an image formed on a preceding sheet, the image formation to a preceding-sheet rear edge and a following-sheet front edge is performed by a same main scanning. When the following-sheet image quality differs from the preceding-sheet image quality, the image formation to the following sheet is performed after the image formation to the preceding-sheet rear edge is completed.

11 Claims, 15 Drawing Sheets

IMAGE FORMING DEVICE

TECHNICAL FIELD

The present invention relates to an image forming device, and more particularly to an image forming device provided with a printing head which discharges a droplet of printing liquid.

BACKGROUND ART

For example, an ink-jet printing device is known as one of image forming devices including a printer, a facsimile, a copier and a multi-function peripheral. The ink-jet printing device uses as a printing head a liquid discharge head to discharge an ink drop, as a droplet of printing liquid, to a recording sheet so that an image is formed on the recording sheet. The material of the recording sheet is not limited to paper, and the term "recording sheet" means that it contains what is called a recording medium, such as a copy sheet, copy paper, etc. Image formation, recording, printing, etc. are synonyms, and this image formation means that it includes not only formation of an image of characters, figures, etc. but also formation of an image of patterns or the like.

As a type of image forming device, a serial type image forming device is known. See Japanese Laid-Open Patent Application No. 2004-122681 and Japanese Laid-Open Patent Application No. 2004-122685. In the serial type image forming device, the printing head having a nozzle sequence with a plurality of nozzles for discharging a droplet of printing liquid is provided in the carriage, and a main scanning of the carriage over the sheet is performed while the sheet is fed intermittently in a direction perpendicular to the main scanning direction by a line feed amount that is less than a length of the nozzle sequence, so that an image is formed on the sheet.

When continuous printing in which images are formed continuously and sequentially to the plurality of sheets is performed with the serial type image forming device, if the sheet feeding is carried out such that the preceding sheet is fed at a time by a distance larger than the feed amount (the amount of line feed) at the time of image formation after the image formation to the preceding sheet is completed, the preceding sheet is ejected and the front edge of the following sheet is transported to the printing position, then the throughput of printing will fall.

To eliminate the problem, there is known a printing device in which printing to the rear edge of the preceding sheet and the front edge of the following sheet is carried out by a same main scanning while the plurality of sheets are transported. See Japanese Laid-Open Patent Application No. 2000-127368.

In the above-mentioned serial type image forming device, in order to shorten the print output time, the transporting speed of ejection operation of the preceding sheet and feeding operation of the following sheet is set up to a high speed as much as possible. For this reason, the sheet position may be made unstable and the sheet gap may become long. Since highly precise line feed transporting (line feed at the time of image formation) and high-speed transporting are mixed, it may induce an unnecessary vibration to the image forming device, the print dot position may be in disorder, and the image quality may deteriorate.

The scanning speed of the carriage depends on the pixel density and the drive frequency of the printing head that is decided according to the setting of dot formation. If the speed of the sheet feeding at the time of image formation is increased, in order to increase the printing speed when performing the continuous printing to the plurality of sheets, the accuracy of sheet stop position deteriorates, and there is a problem that the dot position is in disorder and the image quality deteriorates.

To eliminate the problem, the printing device of Japanese Laid-Open Patent Application No. 2000-127368 is aimed at improving the printing speed when the continuous printing is performed, such that printing to the rear edge of the preceding sheet and the front edge of the following sheet is carried out by a same main scanning and the sheet transporting is performed with a reduced gap between the preceding sheet and the following sheet.

However, even in the above-mentioned image forming device, there still is a problem that it is not is suitable for a case in which the quality of an image formed on the preceding sheet differs from the quality of an image formed on the following sheet. In addition, it is not is suitable for a case in which the timing to receive the data of an image formed on the following sheet delays.

DISCLOSURE OF THE INVENTION

An object of the present invention is to provide an improved image forming device in which the above-mentioned problems are eliminated.

Another object of the present invention is to provide an image forming device which is capable of improving the printing speed at the time of continuous printing as much as possible in the case where the quality of an image formed on the preceding sheet differs from the quality of an image formed on the following sheet, or in the case where the timing to receive the data of an image formed on the following sheet delays.

In order to achieve the above-mentioned objects, the present invention provides an image forming device comprising a carriage on which a printing head is carried, the printing head having a nozzle sequence in which a plurality of nozzles each of which discharges a droplet of printing liquid are arrayed, the image forming device performing a main scanning of the carriage to a sheet and feeding the sheet intermittently in a direction perpendicular to a main scanning direction, so that an image is formed on the sheet, wherein, when a continuous printing of images to a plurality of sheets is performed and a quality level of an image formed on a following sheet is the same as a quality level of an image formed on a preceding sheet, the image formation to both a rear edge of the preceding sheet and a front edge of the following sheet is performed by a same main scanning of the carriage, and wherein, when the quality level of the image formed on the following sheet differs from the quality level of the image formed on the preceding sheet, the image formation to the following sheet is performed after the image formation to the rear edge of the preceding sheet is performed completely.

In order to achieve the above-mentioned objects, the present invention provides an image forming device comprising a carriage on which a printing head is carried, the printing head having a nozzle sequence in which a plurality of nozzles each of which discharges a droplet of printing liquid are arrayed, the image forming device performing a main scanning of the carriage to a sheet and feeding the sheet intermittently in a direction perpendicular to a main scanning direction, so that an image is formed on the sheet, wherein, when a continuous printing of images to a plurality of sheets is performed and a quality level of an image formed on a following sheet is the same as a quality level of an image formed on a preceding sheet, the image formation to both a rear edge of the preceding sheet and a front edge of the following sheet is performed by a same main scanning of the carriage, and wherein, when the quality level of the image formed on the following sheet differs from the quality level of the image formed on the preceding sheet, the image formation is performed with a main scanning speed and an amount of sheet feeding which are suited to the image of a higher quality level.

The above-mentioned image forming device may be configured so that, when the quality level of the image formed on the preceding sheet is higher than the quality level of the image formed on the following sheet, the image formation to the front edge of the following sheet is performed by skipping dots and performing the main scanning of the carriage with a main scanning speed suited to the quality level of the image formed on the preceding sheet, and, after the image formation to the preceding sheet is completed, the image formation is performed with a main scanning speed and an amount of sheet feeding which are suited to the quality level of the image formed on the following sheet.

The above-mentioned image forming device may be configured so that, when the quality level of the image formed on the preceding sheet is lower than the quality level of the image formed on the following sheet, the image formation to the rear edge of the preceding sheet is performed by skipping dots and performing the main scanning of the carriage with a main scanning speed suited to the quality level of the image formed on the following sheet.

The above-mentioned image forming device may be configured so that the image on the preceding sheet and the image on the following sheet are separately formed by respective print jobs.

In order to achieve the above-mentioned objects, the present invention provide an image forming device comprising a carriage on which a printing head is carried, the printing head having a nozzle sequence in which a plurality of nozzles each of which discharges a droplet of printing liquid are arrayed, the image forming device performing a main scanning of the carriage to a sheet and feeding the sheet intermittently in a direction perpendicular to a main scanning direction, so that an image is formed on the sheet, wherein, when a continuous printing of images to a plurality of sheets is performed, the image formation to both a rear edge of the preceding sheet and a front edge of the following sheet is performed by a same main scanning of the carriage, and wherein, when printing data to the following sheet is received during image formation of a print job to the preceding sheet, a feeding control of the following sheet is performed based a remaining time for the image formation to the preceding sheet and a time for feeding of the following sheet.

The above-mentioned image forming device may be configured so that, when the image formation to the preceding sheet and the following sheet by the same main scanning is allowed by performing separation feeding of the following sheet for every amount of line feed, separation feeding of the following sheet is performed by intermittent feeding, and when the image formation to the preceding sheet and the following sheet by the same main scanning is allowed by performing separation feeding of the following sheet by continuous feeding, separation feeding of the following sheet is performed by continuous feeding, and when the image formation to the preceding sheet and the following sheet by the same main scanning is not allowed by intermittent feeding or continuous feed, the image formation to the preceding sheet and the following sheet by the same main scanning is not performed.

The above-mentioned image forming device may be configured so that the image forming device comprises a sheet feeding unit which is capable of separating and feeding a sheet and driven by a drive system that is controllable independently from a drive system which feeds intermittently the sheet when the main scanning of the carriage is performed.

The above-mentioned image forming device may be configured so that a sheet feeding unit which is capable of separating and feeding a sheet and driven by a drive system that is controllable independently from a drive system which feeds intermittently the sheet when the main scanning of the carriage is performed is attachable to the image forming device.

The above-mentioned image forming device may be configured so that the image forming device comprises a transport path for transporting a sheet which is reversed after the image formation to one side of the sheet is completed, and a distance between the preceding sheet and the following sheet along the transport path is set up, during the image formation to the other side of the sheet, to allow the image formation to the rear edge of the preceding sheet and the front edge of the following sheet to be performed by the same main scanning of the carriage.

The above-mentioned image forming device may be configured so that the image forming device comprises an electrostatic transport belt which adsorbs and transports the sheet by an electrostatic force.

According to the image forming device of the present invention, when the quality of the image formed on the following sheet is the same as the quality of the image formed on the preceding sheet at the time of continuous printing of images to the plurality of sheets, the image formation to both the rear edge of the preceding sheet and the front edge of the following sheet is performed by a same main scanning of the carriage. When the quality of the image formed on the preceding sheet differs from the quality of the image formed on the following sheet, the image formation to the following sheet is performed after the image formation to the rear edge of the preceding sheet is performed completely. The image forming device of the present invention is suitable for the case in which the quality of the image formed on the preceding sheet differs from the quality of the image formed on the following sheet, and it is possible to improve the printing speed at the time of continuous printing.

According to the image forming device of the present invention, when the quality of the image formed on the following sheet is the same as the quality of the image formed on the preceding sheet at the time of continuous printing of images to the plurality of sheets, the image formation to both the rear edge of the preceding sheet and the front edge of the following sheet is performed by a same main scanning of the carriage. When the quality of the image formed on the preceding sheet differs from the quality of the image formed on the following sheet, the image formation is performed with a main scanning speed and an amount of sheet feeding which are suited to the image with a higher quality level. The image forming device of the present invention is suitable for the case in which the quality of the image formed on the preceding sheet differs from the quality of the image formed on the following sheet, and it is possible to improve the printing speed at the time of continuous printing.

According to the image forming device of the present invention, the image formation to both the rear edge of the preceding sheet and the front edge of the following sheet is performed by a same main scanning of the carriage at the time of continuous printing of images to the plurality of sheets, and, when the printing data to the following sheet is received during image formation of the print job to the preceding sheet, the feed control of the following sheet is performed based on the remaining time needed for the image formation to the preceding sheet and the time needed for feeding of the following sheet. The image forming device of the present invention is suitable for the case where the timing to receive the printing date to the following sheet delays, and it is possible to improve the printing speed at the time of continuous printing.

Other objects, features and advantages of the present invention will be apparent from the following detailed description when reading in conjunction with the accompanying drawings.

BEST MODE FOR CARRYING OUT THE INVENTION

A description will now be given of an embodiment of the invention with reference to the accompanying drawings.

Figure 1:
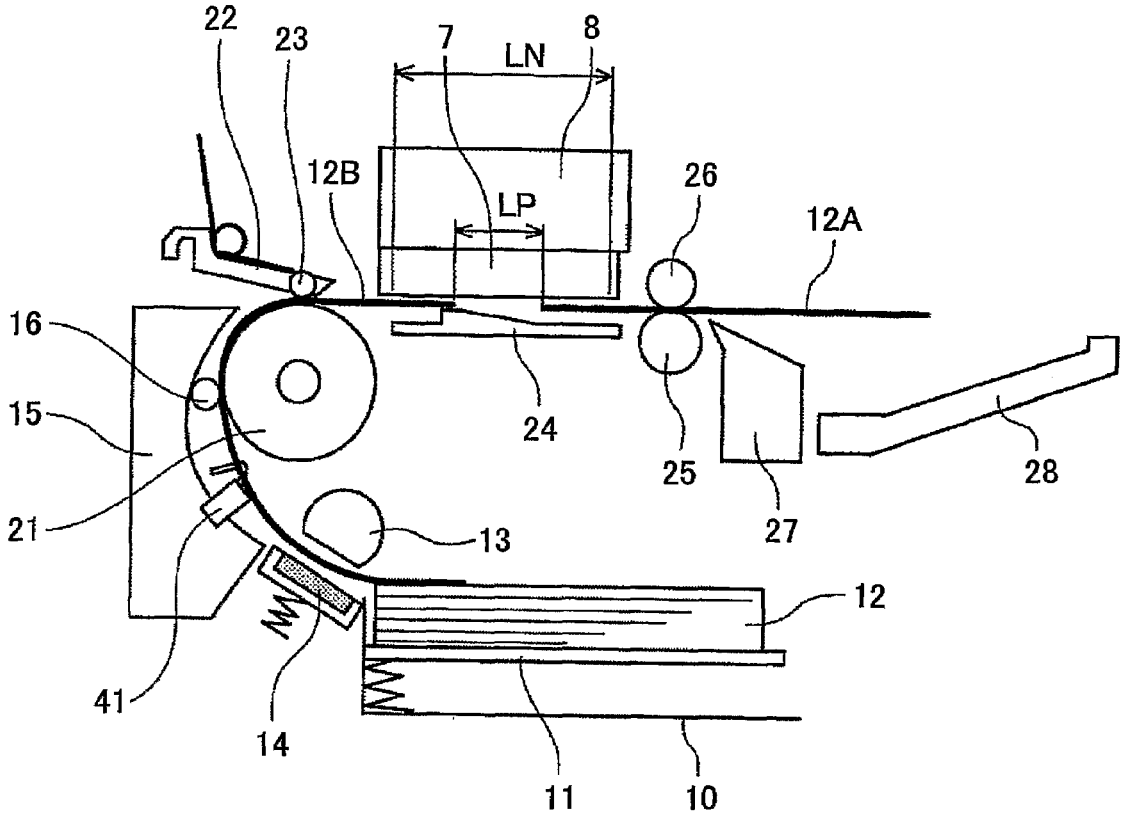
FIG. 1 is a diagram showing an example of the composition of an image forming device of the invention.
Figure 2:
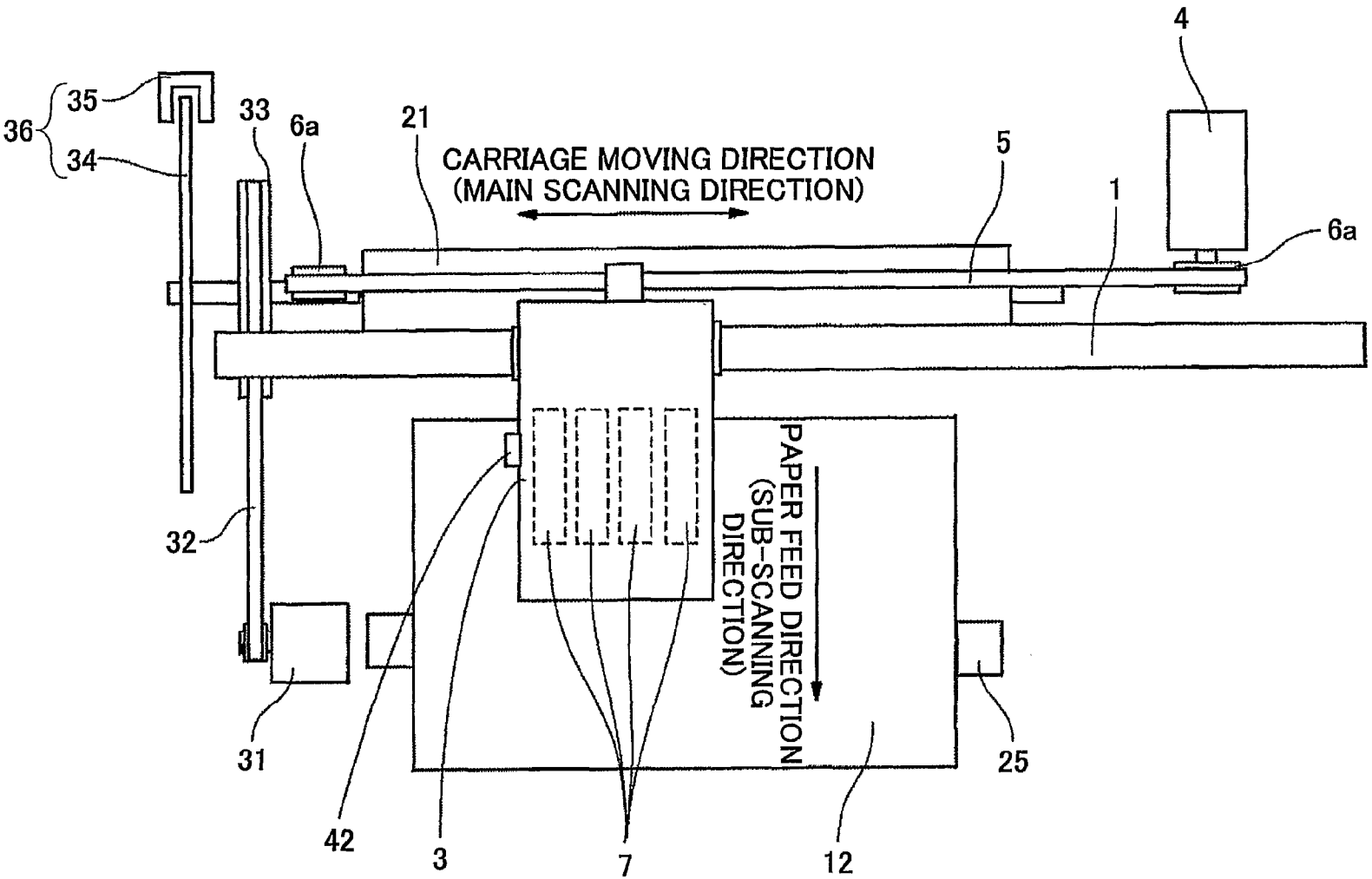
FIG. 2 is a plane diagram showing the principal part of the image forming device.
Figure 3:
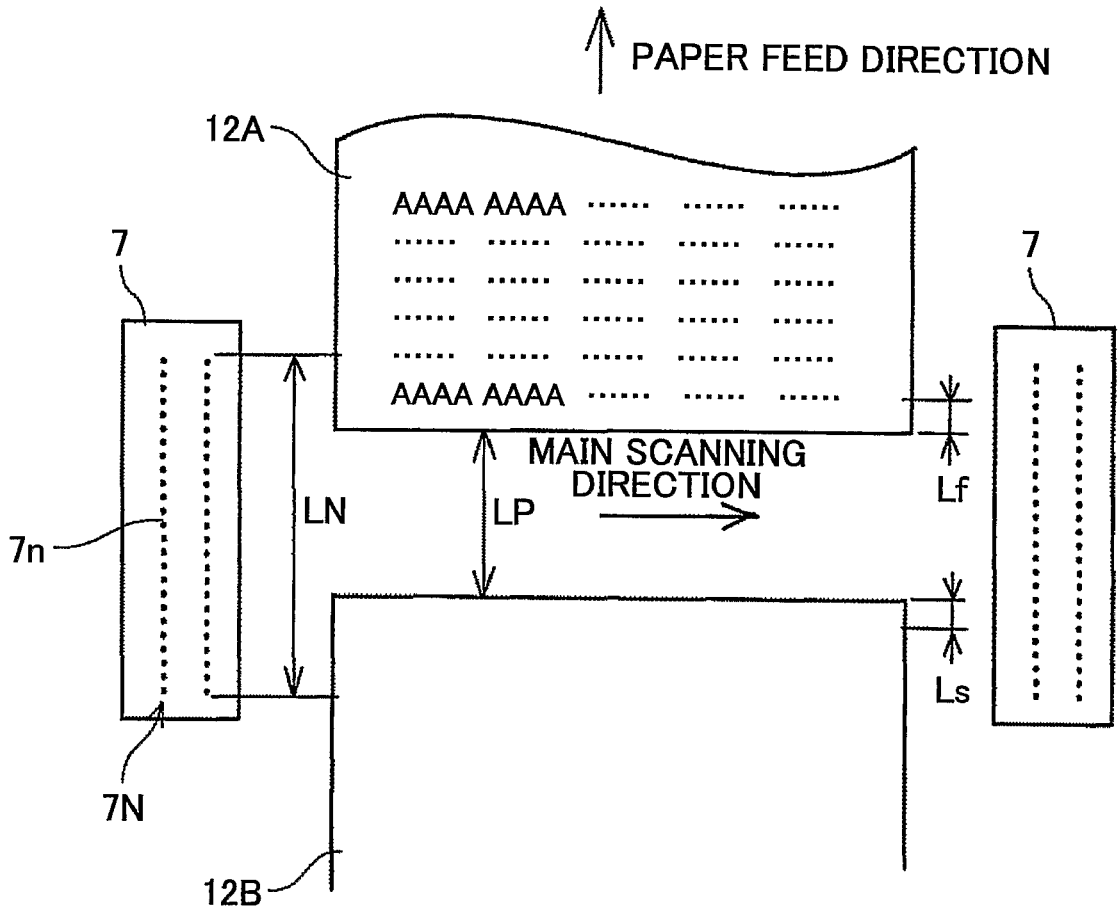
FIG. 3 is a diagram for explaining the operation of the image forming device at the time of continuous printing.

FIG. 1 is a diagram showing an example of the composition of the image forming device of the invention. FIG. 2 is a plane diagram showing the principal part of the image forming device. FIG. 3 is a diagram for explaining the operation of the image forming device at the time of continuous printing.

As shown in FIG. 2, in this image forming device, a carriage 3 is held by the guide rod 1 (which is the guide member provided horizontally across the right and left side plates (not illustrated)) and the guide stay (not illustrated), such that the sliding movement of the carriage 3 in the main scanning direction is enabled. The timing belt 5 is wound between the drive pulley 6*a* and the idler pulley 6*b*, and the scanning of the carriage in the direction (main scanning direction) indicated by the arrow in FIG. 2 is carried out through the timing belt 5 by the main-scanning motor 4.

On the carriage 3, the printing head 7 which includes the four ink jet heads each of which discharges an ink drop of one of the color inks of yellow (Y), cyan (C), magenta (M) and black (Bk) is arranged so that the nozzles (the ink exhaust ports) of the ink jet heads are arrayed in the direction (sub-scanning direction) perpendicular to the main scanning direction. The ink drop discharge direction of each nozzle is directed to the bottom (the downward direction) of the printing head.

As shown in FIG. 3, two rows of the nozzle sequence 7N, each of the two rows including the plurality of nozzles 7*n*, are arranged on the printing head 7.

In the ink jet head which constitutes the printing head 7, an energy generating means for generating the energy to discharge the ink is provided. The energy generating means may be any of a piezoelectric actuator, such as a piezoelectric element, a thermal actuator using the phase change by a temperature change by the boiling of a liquid film using an electric thermal conversion element, such as an exothermic resistor, a shape memory alloy actuator using the metal phase change by a temperature change, an electrostatic actuator using an electrostatic force, etc.

Alternatively, the printing head may be provided by one or a plurality of droplet discharge heads in which a plurality of nozzle sequences which discharges different color ink drops.

The sub-tank 8 of each ink of the four colors for supplying the ink of each color to the printing head 7 is provided in the carriage 3. The ink from the main tank (the ink cartridge) is supplemented or supplied to the sub-tank 8 via the ink supply tube (not illustrated).

Alternatively, a printing head which discharges a treated fixing solution (the fixing ink) which reacts with the printing liquid (ink) in order to increase the fixing ability of the ink may be used, instead of the printing head 7 which discharges an ink drop.

As a sheet feeding part for feeding the sheet 12 loaded on the sheet loading part (pressure plate) 11 of the sheet feeding tray 10, the separating pad 14 which is made of a material having a large friction coefficient is provided. The separating pad 14 is opposed to the semi-circular roller (feed roller) 13 and the the feeding roller 13, and carries out the separation feeding of every sheet of the sheets 12 from the sheet loading part 11, and the separating pad 14 is pressed against the the feeding roller 13 side.

And the sheet 12 sent from the sheet feeding part is guided upward by the transporting guide 15, and sent to the position between the transport roller 21 and the the registration roller 16. Further, the direction of the sheet 12 is changed by about 90 degrees, and the sheet 12 is sent by the transport roller 21, and sent from the area between the sheet retaining roller 23 and the transport roller 21 which is pushed by the retaining member 22 to the image forming area where the image is formed by the printing head 7.

The guide member 24 which guides the movement of the sheet 12 being transported is arranged in the image forming area where the image is formed by the printing head 7 and the guide member 24 is opposed to the printing head 7.

The sheet retaining rollers 26, such as the ejection roller 25 or the like, is arranged in the downstream of the image forming area of the printing head 7, and the ejection stack tray 27 which stacks the sheets 12 ejected from the area between the ejection rollers 25 and the sheet retaining rollers 26 is provided.

As shown in FIG. 2, the slit disc 34 is attached to the shaft of the transport roller 21, and the sensor 35 which detects the slit of the slit disc 34 is provided in the slit disc 34. And the slit disc 34 and the sensor 35 constitute the encoder 36.

As shown in FIG. 1, the sheet presence sensor 41 which detects the existence of the sheet 12 in the transporting path between the feeding roller 13 and the registration roller 16 is provided, and the paper sensor 42 which can be used to detect the front edge of the sheet 12, or the both ends of the sheet 12 is provided in the carriage 3.

Figure 4:
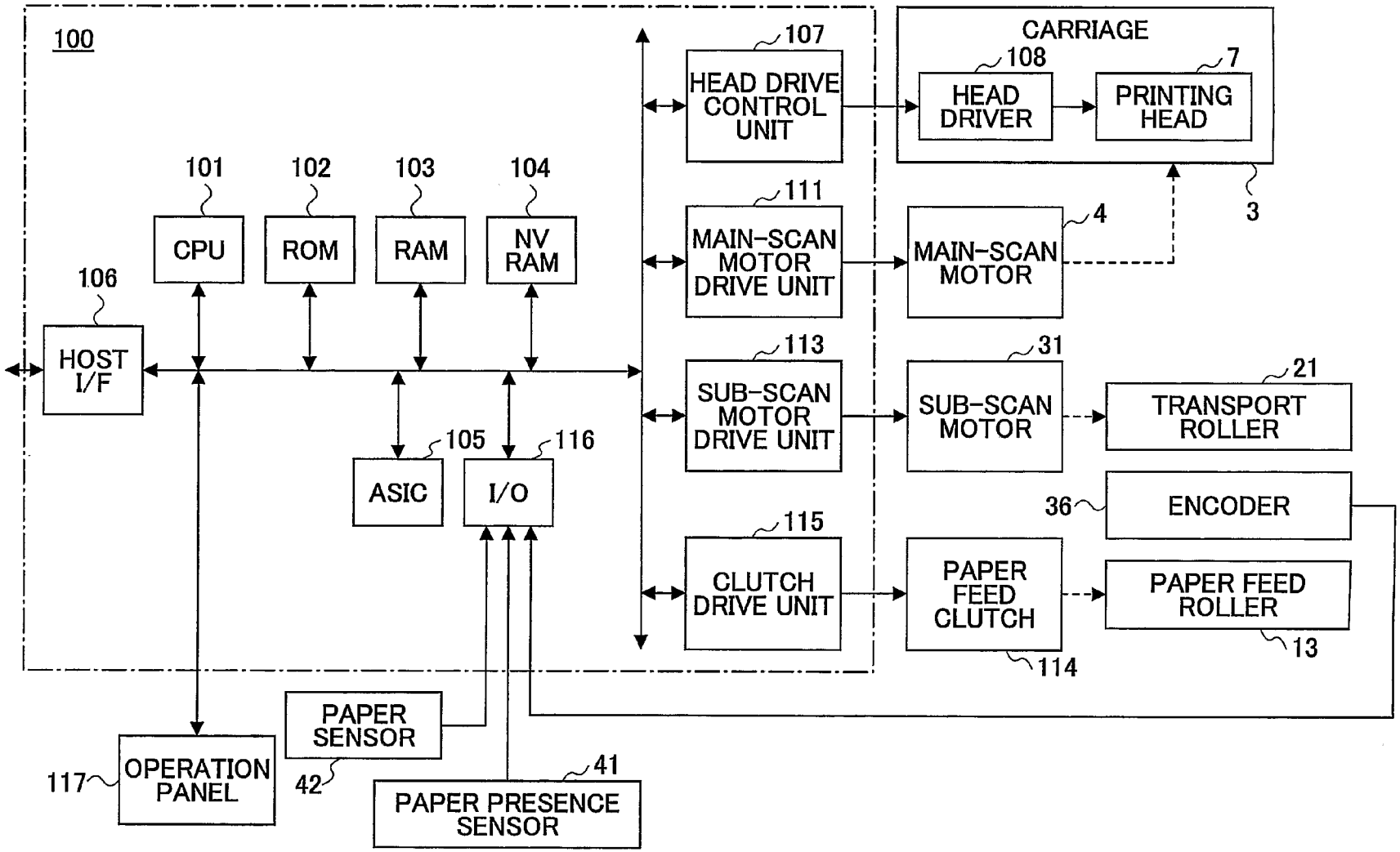
FIG. 4 is a block diagram showing the composition of a control unit of the image forming device.

Next, FIG. 4 shows the composition of the control unit of the image forming device in this embodiment.

As shown in FIG. 4, the control unit 100 comprises a CPU 101, a ROM 102, a RAM 103, a nonvolatile memory 104, and an ASIC 105. The CPU 101 controls the whole image forming device. The program executed by the CPU 101 and other fixed data are stored in the ROM 102. The RAM 103 temporarily stores image data etc. The nonvolatile memory 104 is a rewritable storage medium which holds data safely even when the power supply of the image forming device is stopped. The ASIC 105 processes the image processing of various signals to image data, processes the image processing, such as rearrangement, etc., and processes the input/output signals for controlling the whole image forming device.

The control unit 100 further comprises a host interface (I/F) 106, a head drive control unit 107, a head driver 108, a main-scan motor drive unit 111, a sub-scan motor drive unit 113, a clutch drive unit 115, and an I/O interface 116. The host I/F 106 is used to transmit or receive the data and the signals between the host system (the data processing device or personal computer) and the image forming device. The head drive control unit 107 is provided to control the driving of the printing head 7. The head driver 108 is provided in the carriage 3.

The main-scan motor drive unit 111 is provided to drive the main-scanning motor 4. The sub-scanning motor drive unit 113 is provided to drive the sub-scanning motor 31. The clutch drive unit 115 is provided to drive or control ON/OFF of the sheet feeding clutch 114 which transmits the rotation to the feeding roller 13 etc. The I/O interface 116 is provided to input the detection signals from various sensors, such as the sensor 35 of the encoder 36, the sheet presence sensor 41, and the paper sensor 42.

The operation panel 117 which is provided to input and display the information required for the image forming device is connected to the control unit 100.

The control unit 100 receives the printing data including the image data from the host system, including an imaging device, such as a digital camera, an image reader, such as an image scanner, and the data processing device, such as a personal computer, via the cable or via the network, by using the host I/F 106. The printer driver on the side of the host system performs creation and outputting of the printing data to the control unit 100.

And the CPU 101 reads and analyzes the printing data in the receiving buffer contained in the host I/F 106, causes the ASIC 105 to perform the rearrangement processing of the printing data, and transmits the image data to the head drive control unit 107.

When the image data (dot pattern data) equivalent to one line of the printing head 7 are received, the head drive control unit 107 transmits the dot pattern data for one line to the head driver 108 as the serial data in synchronization with a clock signal, and transmits a latch signal to the head driver 108 at a predetermined timing. The head drive control unit 107 includes a ROM in which the pattern data of the drive waveform (driving signal) are stored (which ROM may also be constituted by the ROM 102), a waveform generating circuit including a D-A converter which carries out D/A conversion of the data of a drive waveform read from the ROM, and a drive waveform generating circuit which is comprised of an amplifier. The head drive control unit 107 supplies the generated drive waveform to the head driver 108.

The head driver 108 includes a shift register which inputs the clock signal and the serial data which are the image data from the head drive control unit 107, a latch circuit which latches the registration value of the shift register by the latch signal from the head drive control unit 107, a level conversion circuit (level shifter) which carries out level change of the output value of the latch circuit, and an analog switch array (switching unit) the ON/OFF state of which is controlled by the level shifter. The head driver 108 controls the ON/OFF state of the analog switch array, and selectively applies the desired drive waveform contained in the drive waveform, to the actuator unit of the printing head 7 so that the printing head 7 is driven.

The main-scanning motor drive unit 111 computes a control value based on the speed detection value which is acquired by sampling of the detection pulse from the encoder (which is not illustrated) and the target value given from the CPU 101 side, and drives the main-scanning motor 4 through the internal motor driver.

Similarly, the sub-scanning motor drive control unit 113 computes a control value based on the speed detection value which is acquired by sampling of the detection pulse from the encoder 36 and the target value given from the CPU 101 side, and drives the sub-scanning motor 31 through the internal motor driver.

In the above-described image forming device, the separation feeding of one of the sheets 12 is carried out from the sheet feeding part, and the transporting of the supplied sheet 12 is guided by the transporting guide 15. After the sheet edge is positioned between the transport roller 21 and the registration roller 16, the transporting path is changed and the sheet is sent from the area between the control roller 23 and the transport roller 21 to the sheet guide member 24.

Then, the sheet 12 is fed and stopped, and the printing head 7 is driven in accordance with the image signal while the carriage 3 is moved, so that the ink drops are discharged to the sheet 12 which is stopped, and one line of the image is printed on the sheet 12. And when the printing of one scanning line is completed, the transport roller 21 is driven and the sheet 12 is fed by a predetermined amount of feeding (the predetermined amount of line feed), and the printing of the following line is performed. When the print end signal or the signal indicating that the read edge of the sheet 12 arrives at the printing area is received, the printing operation is terminated and the sheet 12 is ejected to the ejection stack tray 27.

Next, the case where continuous printing (printing is performed continuously to the sheets while the sheets are fed one by one, wherein an image is formed on each sheet) is performed by the image forming device of this embodiment will be explained with reference to FIG. 3 and FIG. 5.

Figure 5:
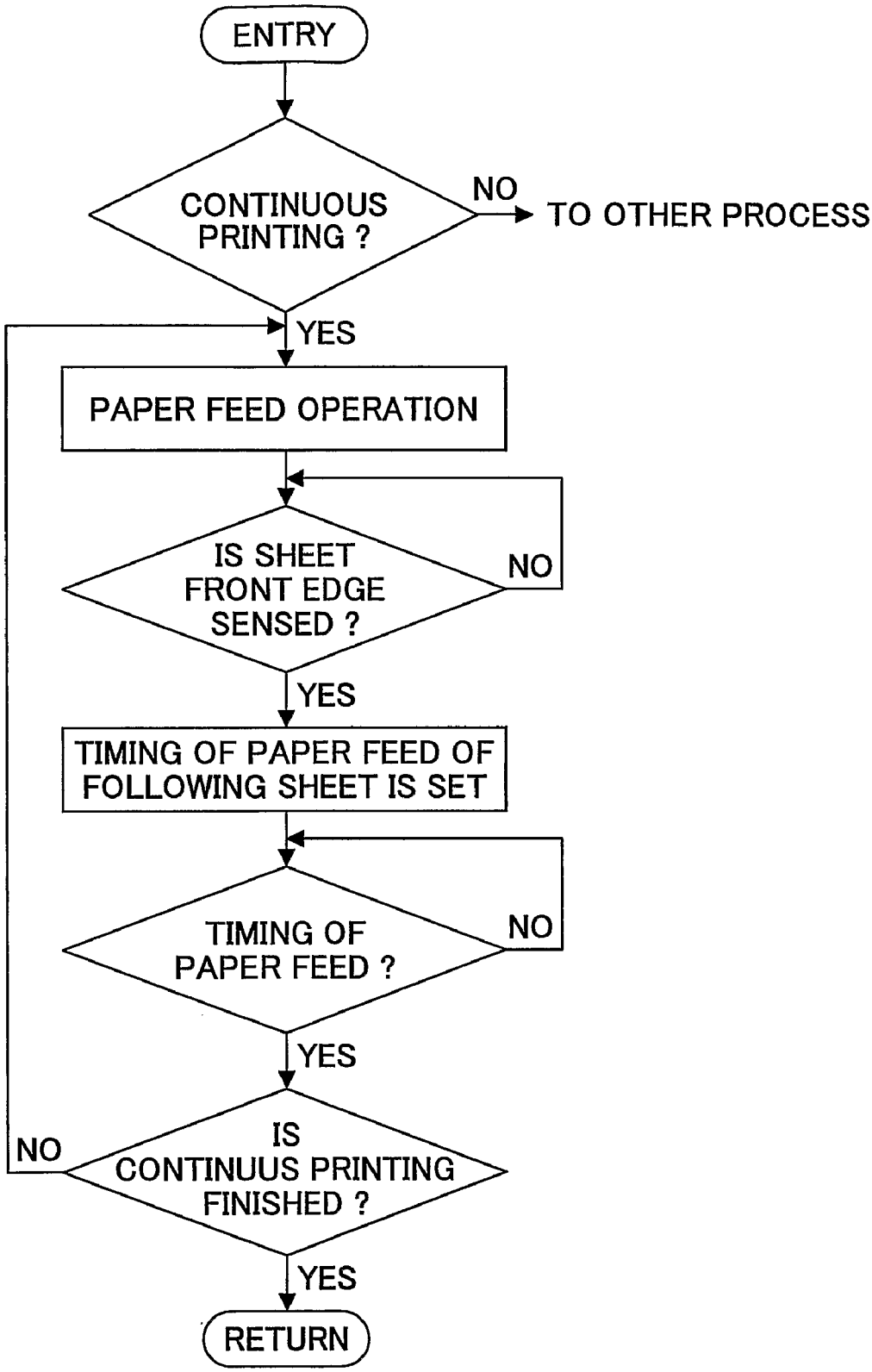
FIG. 5 is a flowchart for explaining the feed operation of the image forming device at the time of continuous printing.

As shown in FIG. 5, when the sheet presence sensor 41 detects, during the continuous printing, the front edge of the preceding sheet 12A after the feed operation to feed the preceding sheet 12A (see FIG. 1) is performed, the feeding timing of the following sheet 12B is set up when the sheet gap LP between the preceding sheet 12A and the following sheet 12B is below the length LN of the nozzle sequence 7N of the printing head 7 in the direction of sheet feeding (LP<=LN), as shown in FIG. 3.

If it is not the end of the continuous printing at the feeding timing of the following sheet 12B, the feed operation is continuously performed. And the same procedure in which the following paper 12B is changed to the preceding sheet and the feed operation of a next sheet is performed is repeated until the end of the continuous printing is reached.

Accordingly, at the time of continuous printing, as shown in FIG. 3, the preceding sheet 12A and the following sheet 12B are transported so that the sheet gap LP is below the length LN of the nozzle sequence 7N of the printing head 7. It is possible to perform the sheet feeding operation at a stable speed, without the need for performing the sheet feeding operation of the following sheet 12B at high speed, after the ejection operation of the preceding sheet 12A is performed.

Thus, the sheet gap between the preceding sheet and the following sheet is made to be less than the nozzle sequence length when the plurality of sheets are continuously fed one by one and an image is formed on each sheet. The vacant time in the printing speed corresponding to the sheet distance between the sheets can be shortened, and the useless movement of the sheet transporting system in the ejection operation of the sheet or the feed operation can be omitted, and it is possible to improve the printing speed and the printing efficiency.

As described above, the gap between the preceding sheet and the following sheet is made to be less than the nozzle sequence length during the continuous printing. When the image formation to the preceding sheet 12A is performed and the density of the image formed on the preceding sheet 12A is higher than the nozzle density of the printing head 7, interlacing printing in which the preceding sheet 12A is fed in such an amount of line feed (the amount of sheet feeding) that the dots formed by one main scanning are filled (line feed operation) is performed.

In this case, the following sheet 12B and the subsequent sheets are fed in the amount of line feed by which the preceding sheet 12A is fed. At this time, also when the separation feeding of the subsequent sheets following the following sheet 12B is performed, they are fed in the amount of line feed concerned.

Thus, when forming the images with the same image quality on the plurality of sheets, after the start of the image formation to the first sheet and before the end of the image formation to the last sheet, each of the plurality of sheets is fed in the amount of sheet feed at the time of image formation. Thereby, it is possible to carry out the sheet feeding in a stable manner while the above-mentioned conditions of LP<=LN are maintained.

Also when the separation feeding of the sheets is performed from the location where the sheets are loaded, each of the plurality of sheets is fed in the amount of sheet feed at the time of image formation and the sheet separation is performed. Thereby, it is possible to carry out the sheet feeding in a stable manner while the above-mentioned conditions of LP<=LN are maintained.

Next, the case in which the image formation to the rear edge of the preceding sheet and the image formation to the front edge of the following sheet are performed by a same main scanning will be explained with reference to FIG. 6.

In this case, the feeding of the following sheet 12B is started at the timing that the combined length (LP+Lf+Ls) which is obtained by combining the sheet gap LP between the preceding sheet 12A and the following sheet 12B, the rear edge space Lf of the preceding sheet 12A, and the front edge space Ls of the following sheet 12B is shorter than the nozzle sequence length LN of the printing head 7. Namely, the feeding of the following sheet 12B is started at the timing that the conditions of (LP+Lf+Ls)<=LN are met.

Figure 6:
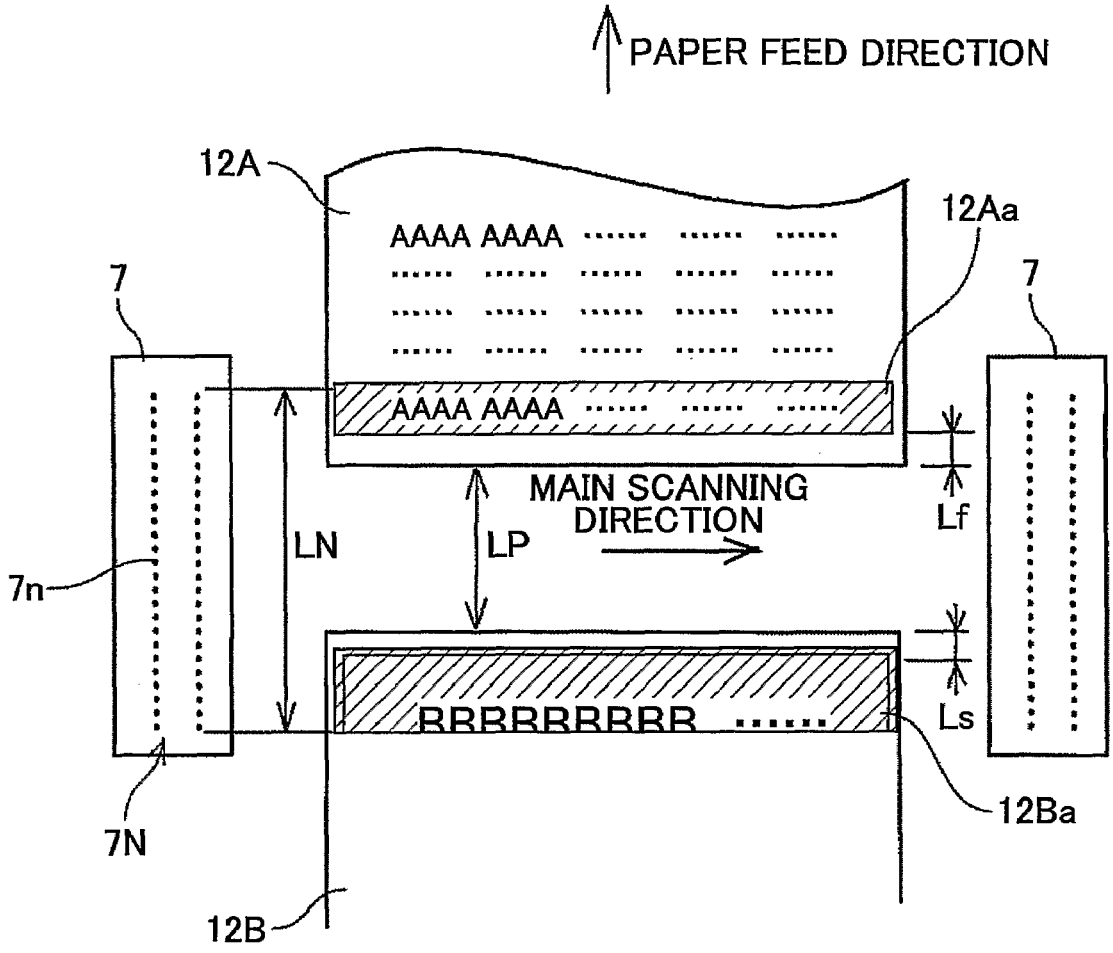
FIG. 6 is a plane diagram for explaining the case in which an image is formed on the preceding sheet and the following sheet by a same main scanning at the time of continuous printing.

Thereby, the image formation to the rear edge 12Aa of the preceding sheet 12A and the image formation to the front edge 12Ba of the following sheet 12B can be performed by the same main scanning with respect to the area of {LN−(LP+Lf+Ls)} (the shaded area in the example of FIG. 6).

Next, the setting of the feeding timing of the following sheet 12B will be explained. By using the paper sensor 42 of the carriage 3, the front edge of the sheet 12 is detected and the feeding timing of the following sheet 12B is set up based on the sheet front edge position of the preceding sheet 12A detected, the feeding amount at the time of image formation (the amount of line feed), the sheet gap LP between the preceding sheet 12A and the following sheet 12B.

As described previously, the feeding timing of the following sheet 12B can be suited to the start timing of line feed operation or can also be suited to the timing in the middle of line feed operation.

Thus, based on the number of main scanning lines in the image formation to the preceding sheet and the amount of feeding of the preceding sheet, and based on the transporting distance from the standby position of the sheet to the image formation position, the feeding timing of the following sheet is started. Namely, the feeding timing of the following sheet is synchronized with the image write-in timing to the preceding sheet, and the error of the feeding timing of the following sheet can be reduced. And the sheet distance between the read edge of the preceding sheet and the front edge of the following sheet can be made highly precise.

As mentioned above, when images are continuously formed on the plurality of sheets, if the timing that the front edge of the preceding sheet or the rear edge of the following sheet is detected by the sheet presence sensor, and the feeding of the following sheet is started, then the influences of the delay of paper detection, the detection error and the processing timing of a detection signal, etc., causes an error to arise in the feeding of the following sheet. In such a case, the accuracy of the sheet distance between the sheets will fall, and the image quality will deteriorate.

To eliminate the problem, the sheet distance between the sheets can be secured with high precision by synchronizing the feeding timing of the following sheet with the image write-in timing to the preceding sheet, and it is possible to improve the image quality.

Figure 7:
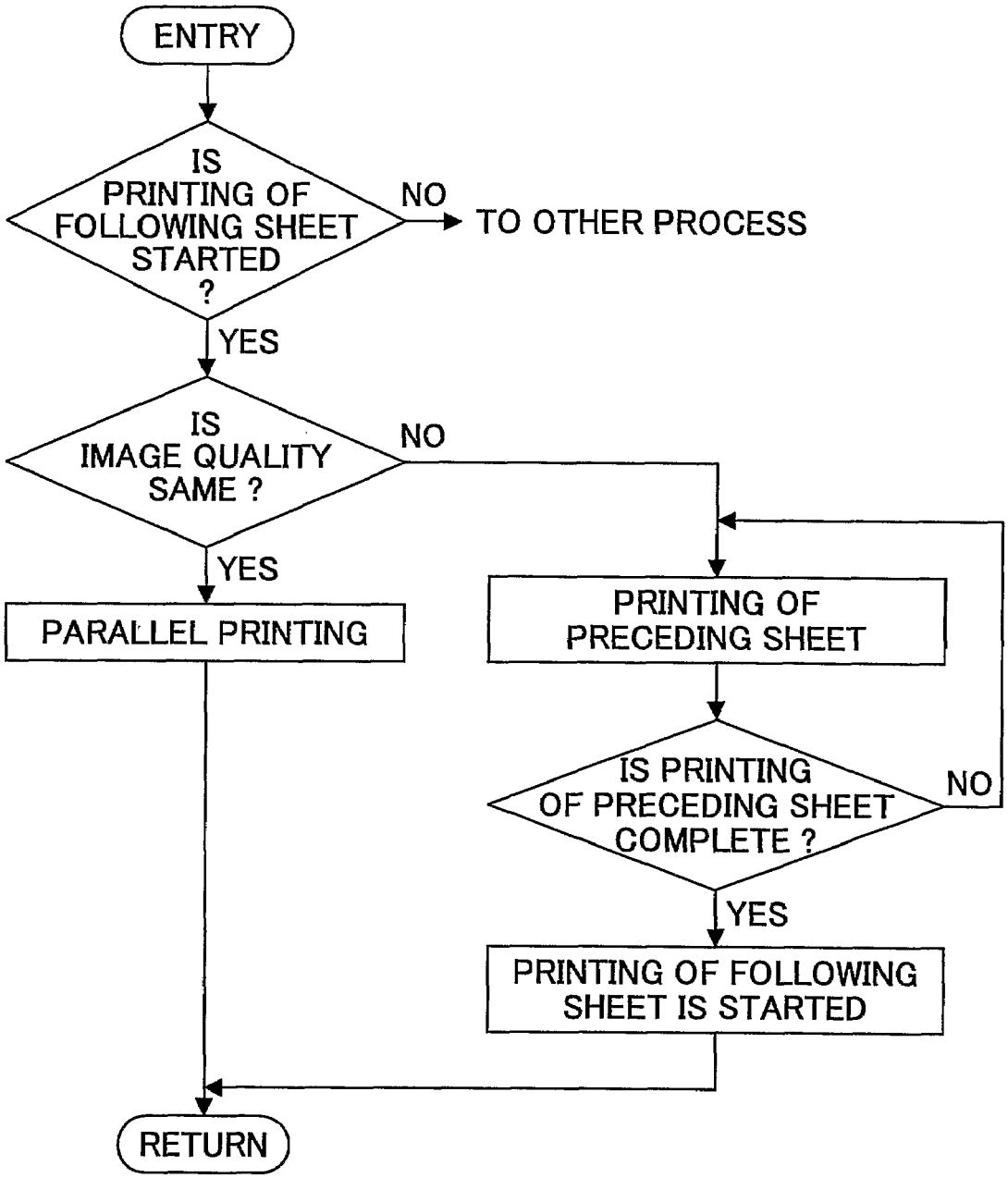
FIG. 7 is a flowchart for explaining the operation of the image forming device in an embodiment of the invention.

Next, the image forming device in an embodiment of the invention will be explained with reference to FIG. 7 and FIG. 6.

As mentioned above, when the image formation to the rear edge of the preceding sheet and the front edge of the following sheet is performed by a same main scanning, the image quality of the image formed on the preceding sheet may differ from the image quality of the image formed on the following sheet. For example, there is a case in which the pixel density of the image formed to the rear edge 12Aa of the preceding sheet 12A may differ from the pixel density of the image formed to the front edge 12Ba of the following sheet 12B.

For example, the image formed on the preceding sheet 12A is a 300 dpi image chiefly including a character image, and the image formed on the following sheet 12B is a 600 dpi image chiefly including a photographic image. Suppose that the nozzle density of the printing head 7 in this case is 300 dpi, and the amount of line feed of the image formation to the preceding sheet 12A is set to the nozzle sequence length LN. The amount of line feed of the image formation to the following sheet 12B is set to be equal to {(nozzle sequence length LN)/2}, and the amounts of line feed of both the image formations are different, and the scanning speeds are also different.

To eliminate the problem, the image forming device of this embodiment is configured so that, while the image formation to the rear edge of the preceding sheet and the front edge of the following sheet is performed by a same main scanning, and when the image quality of the image formed on the rear edge 12Aa of the preceding sheet 12A differs from the image quality of the image formed on the front edge 12Ba of the following sheet 12B, the image formation to the following sheet 12B is started after all the image formation to the preceding sheet 12A is performed, and the image formation to the following sheet 12B is performed based on the main scanning speed and the amount of line feed which are suited to the image formed on the following sheet 12B.

A description will be given of the above-mentioned processing of the image forming device of this embodiment with reference to FIG. 7. As shown in FIG. 7, when the front edge of the following sheet 12B is detected and the printing start timing to the following sheet 12B is reached, it is determined whether the image quality of the image formed on the front edge 12Ba of the following sheet 12B is the same as the image quality of the image formed on the rear edge 12Aa of the preceding sheet 12A.

When it is determined that the image quality of the image formed on the front edge 12Ba of the following sheet 12B is the same as the image quality of the image formed on the rear edge 12Aa of the preceding sheet 12A, the parallel printing in which the image formation to the rear edge 12Aa of the preceding sheet 12A and the image formation to the front edge 12Ba of the following sheet 12B are performed by the same main scanning as mentioned above.

On the other hand, when it is determined that the image quality of the image formed on the front edge 12Ba of the following sheet 12B is not the same as (or differs from) the image quality of the image formed on the rear edge 12Aa of the preceding sheet 12A, only the printing to the rear edge 12Aa of the preceding sheet 12A is performed, and the printing to the following sheet 12B is started after the printing to the rear edge 12Aa of the preceding sheet 12A is completed.

Namely, in the conventional image forming device, when forming the same image on the plurality of sheets continuously (or when a printing job to the plurality of sheets is performed continuously), the image quality (pixel density) is settled uniquely. In a case in which a character image is formed on the first sheet and a photographic image is formed on the next sheet, it is necessary to perform the printing in accordance with a selected one of the image quality of the first sheet and the image quality of the next sheet.

In contrast, according to the present embodiment, when the pixel density of the image formed on the preceding sheet differs from the pixel density of the image formed on the following sheet, the image formation to the following sheet is performed, after the image formation of the rear edge of the preceding sheet is completed, by an amount of feeding different from that at the time of feeding of the preceding sheet. It is possible to shorten the total printing time as much as possible while the desired image quality is maintained.

Figure 8:
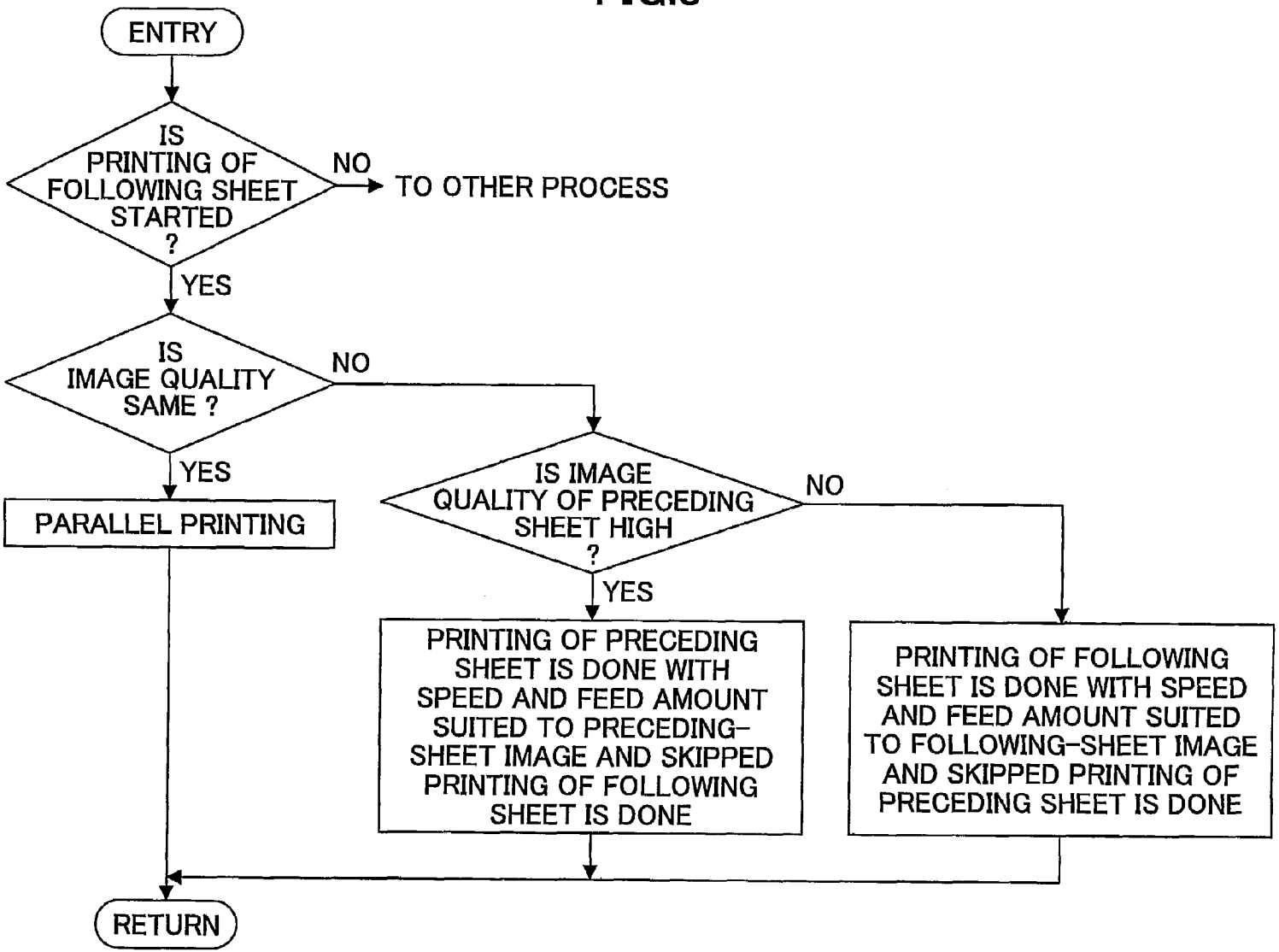
FIG. 8 is a flowchart for explaining the operation of the image forming device in another embodiment of the invention.

Next, the image forming device in another embodiment of the invention will be explained with reference to FIG. 8 and FIG. 6.

The image forming device of this embodiment is configured so that, when the image quality of the image formed on the preceding sheet differs from the image quality of the image formed on the following sheet, the image formation is performed with the main scanning speed and the amount of line feed (the amount of sheet feeding) which are suited to the image of a higher image quality. The image formation to the image of a lower image quality is performed by skipping dots and performing the main scanning of the carriage with the main scanning speed suited to the image of the lower image quality. Thus, even when the image quality of the image formed on the preceding sheet differs from the image quality of the image formed on the following sheet, the image formation to the rear edge of the preceding sheet and the image formation to the front edge of the following sheet can be performed by the same main scanning.

For example, when the image quality of the image formed on the preceding sheet 12A is higher than the image quality of the image formed on the following sheet 12B (or when the nozzle density of the printing head 7 is 300 dpi, the image formed on the preceding sheet 12A is a 600 dpi image mainly including a photographic image and the image formed on the following sheet 12B is a 300 dpi image mainly including a character image), the amount of line feed when forming the image on the preceding sheet 12A is set to {(nozzle sequence length LN)/2}, and the amount of line feed when forming the image on the following sheet 12B is set to (nozzle sequence length LN).

Since the image formation to the rear edge 12Aa of the preceding sheet 12A and the image formation to the front edge 12Ba of the following sheet 12B are performed by the same main scanning, the amount of line feed (sheet feeding) which is used before the image formation to the rear edge 12Aa of the preceding sheet 12A is completed is set to {(nozzle sequence length LN)/2} which is the amount of line feed when forming the image on the preceding sheet 12A, and the image formation is performed with such amount of line feed.

At this time, the image formation to the front edge 12Ba of the following sheet 12B is performed such that the main scanning speed is unchanged and the timing which discharges a dot at the time of printing of the main scanning line is skipped, at the pixel density of 300 dpi. Since the range of the front edge 12Ba of the following sheet 12B corresponds to the density (300 dpi) of the printing head 7, the image formation in the sub-scanning direction is completed by one main scanning.

After the image formation to the rear edge 12Aa of the preceding sheet 12A is completed, the feeding control of the sheet is carried out so that the sheet is continuously fed to the position of the printing head 7 where the range of the image formation end of the following sheet 12B overlaps with the nozzle edge nearest to the ejection side. Then, the image formation to the following sheet 12B is performed while the sheet is fed in the sub-scanning direction by the amount of line feed (nozzle sequence length LN) suited to the pixel density of the image being formed.

On the other hand, when the image quality of the image formed on the following sheet 12B is higher than the image quality of the image formed on the preceding sheet 12A (for example, when the image for the preceding sheet 12A is a 300 dpi image, such as a character image, and the image for the following sheet 12B is a 600 dpi image, such as a photographic image), the amount of line feed used for the image formation to the preceding sheet 12A is set to (nozzle sequence length LN), and the amount of line feed used for the image formation to the following sheet 12B is set to {(nozzle sequence length LN)/2} if the nozzle density of the printing head 7 is 300 dpi.

In this case, the image formation to the rear edge 12Aa of the preceding sheet 12A and the image formation to the front edge 12Ba of the following sheet 12B are performed by the same main scanning. At least after the timing that the image is to be formed to the front edge 12Ba of the following sheet 12B during the image formation to the preceding sheet 12A occurs, the amount of line feed is set to {(nozzle sequence length LN)/2} which is the amount of line feed (sheet feeding) used for the image formation to the following sheet 12B. At this time, some of the nozzles in the sheet feeding direction are skipped, the other nozzles are selected and the interlacing line feed is performed in the image formation to the rear edge 12Aa of the preceding sheet 12A so as to meet the pixel density of 300 dpi.

Moreover, as for the main scanning direction, the main scanning speed is set to the lower one of the main scanning speed for the 300 dpi image formation and the main scanning speed for the 600 dpi image formation. Generally, the main scanning speed at the time of 600 dpi formation is the same or the lower speed. The main scanning speed for the image formation to the preceding sheet 12A is set as mentioned above, and the intervals of discharging dots to the sheet are increased and the printing of the main scanning line is performed at the density of 300 dpi. The nozzle density of the printing head 7 is 300 dpi, and the image formation in the range of the front edge 12Ba of the following sheet 12B is completed with two sub-scanning lines in the sheet feeding direction.

When the printing to the both edges of the preceding sheet 12A and the following sheet 12B is started, the amount of line feed in the sheet feeding direction is suited to the image formation of 600 dpi. After the image formation in the range of the rear edge 12Aa of the preceding sheet 12A is completed, the feeding of the sheet is succeedingly performed by the intermittent feeding with the amount of line feed which is set to {(nozzle sequence length LN)/2}, and the image formation to the following sheet 12B is performed.

A description will be given of the above-mentioned processing with reference to FIG. 8. When the edge of the following sheet 12B is detected, the print start timing of the image formation to the following sheet 12B occurs. At this time, it is determined whether the image quality of the image formed on the front edge 12Ba of the following sheet 12B is the same as the image quality of the image formed on the rear edge 12Aa of the preceding sheet 12A.

When the image quality of the image formed on the front edge 12Ba of the following sheet 12B is the same as the image quality of the image formed on the rear edge 12Aa of the preceding sheet 12A, the above-mentioned parallel printing is carried out. Namely, the image formation to the rear edge 12Aa of the preceding sheet 12A and the image formation to the front edge 12Ba of the following sheet 12B are performed by the same main scanning.

On the other hand, when the image quality of the image formed on the front edge 12Ba of the following sheet 12B is not the same as the image quality of the image formed on the rear edge 12Aa of the preceding sheet 12A, it is determined whether the image quality of the image formed on the rear edge 12Aa of the preceding sheet 12A is higher than the image quality of the image formed on the front edge 12Ba of the following sheet 12B.

When the image quality of the image formed on the preceding sheet 12A is higher, the main scanning and the line feed operation are performed at the main scanning speed and the amount of sheet feeding which are suited to the image formed on the preceding sheet 12A, so that the image is formed on the rear edge 12Aa of the preceding sheet 12A. And while the same main scanning is used and dots are skipped, the image is formed on the front edge 12Ba of the following sheet 12B. The image formation to the following sheet 12B which is performed while dots are skipped means that the image is formed in the main scanning direction with the pixel density of the image formed on the following sheet 12B.

When the image quality of the image formed on the preceding sheet 12A is lower than the image quality of the image formed on the following sheet 12B (or when the image quality of the image formed on the following sheet 12B is higher), the main scanning and the line feed operation are performed at the main scanning speed and the amount of sheet feeding which are suited to the image formed on the preceding sheet 12A so that the image is formed on the front edge 12Ba of the following sheet 12B. And while the same main scanning is used and dots are skipped, the image is formed on the rear edge 12Aa of the preceding sheet 12A.

The image formation to the preceding sheet 12A which is performed while dots are skipped means that the image is formed in the main scanning direction with the pixel density of the image formed on the preceding sheet 12A.

Accordingly, when the image quality of the image formed on the following sheet is the same as the image quality of the image formed on the preceding sheet when forming the images on the plurality of sheets continuously, the image is formed on the rear edge of the preceding sheet and the front edge of the following sheet by the same main scanning of the carriage.

When the image quality of the image formed on the preceding sheet differs from the image quality of the image formed on the following sheet, the image quality forms an image in the scanning speed and the amount of sheet feedings which are suited to the image of a higher quality level, improvement in the printing speed at the time of continuous printing can be aimed at corresponding, also when the image quality of the image formed on the preceding sheet differs from the image quality formed on the following sheet.

When the image quality of the image formed on the preceding sheet is higher than the image quality of the image formed on the following sheet, the main scanning is performed to the front edge of the following sheet at the scanning speed suited to the image quality of the image formed on the preceding sheet, skip a dot and an image is formed.

The image formation is continued by the scanning speed and the amount of sheet feeding which are suited to the image quality of the image formed on the following sheet after the end of the image formation to the preceding sheet. Even when the image quality of the image formed on the preceding sheet is higher than the image quality of the image formed on the following sheet, the image formation to the preceding sheet and the image formation to the following sheet the image quality of which are different can be performed by the same main scanning.

When the image quality of the image formed on the preceding sheet is lower than the image quality of the image formed on the following sheet, the image formation to the rear edge of the preceding sheet is performed while dots are skipped and the main scanning is performed at the main scanning speed suited to the image quality of the image formed on the following sheet. Even when the image quality of the image formed on the following sheet is lower than the image quality of the image formed on the preceding sheet, the image formation to the preceding sheet and the image formation to the following sheet the image quality of which are different can be performed by the same main scanning.

The case in which the image quality of the image formed on the preceding sheet differs from the image quality of the image formed on the following sheet, may be the case in which the image quality for the preceding sheet differs from the image quality for the following sheet within the same print job, or the case in which they differ in different print jobs. One example of the latter case is that the image containing the photographic image only is formed on the preceding sheet and the image containing the character image only is formed on the following sheet by different print jobs.

When images with different image quality levels are printed on a single sheet, the image quality of the image formed on the rear edge of the preceding sheet and the image quality of the image formed on the front edge of the following sheet may be different from each other.

For example, when the setting of the area and the pixel density within one sheet is possible by using the printer driver on the side of the host system (or when the printing of the photographic image part is set to a comparatively high pixel density), or when an image reader is provided in the image forming device and the setting of the area and the pixel density is possible, the image quality differs without one sheet. When the image quality for the rear edge of the preceding sheet differs from the image quality for the front edge of the following sheet, the image forming device of the invention is applicable similarly.

Figure 9:
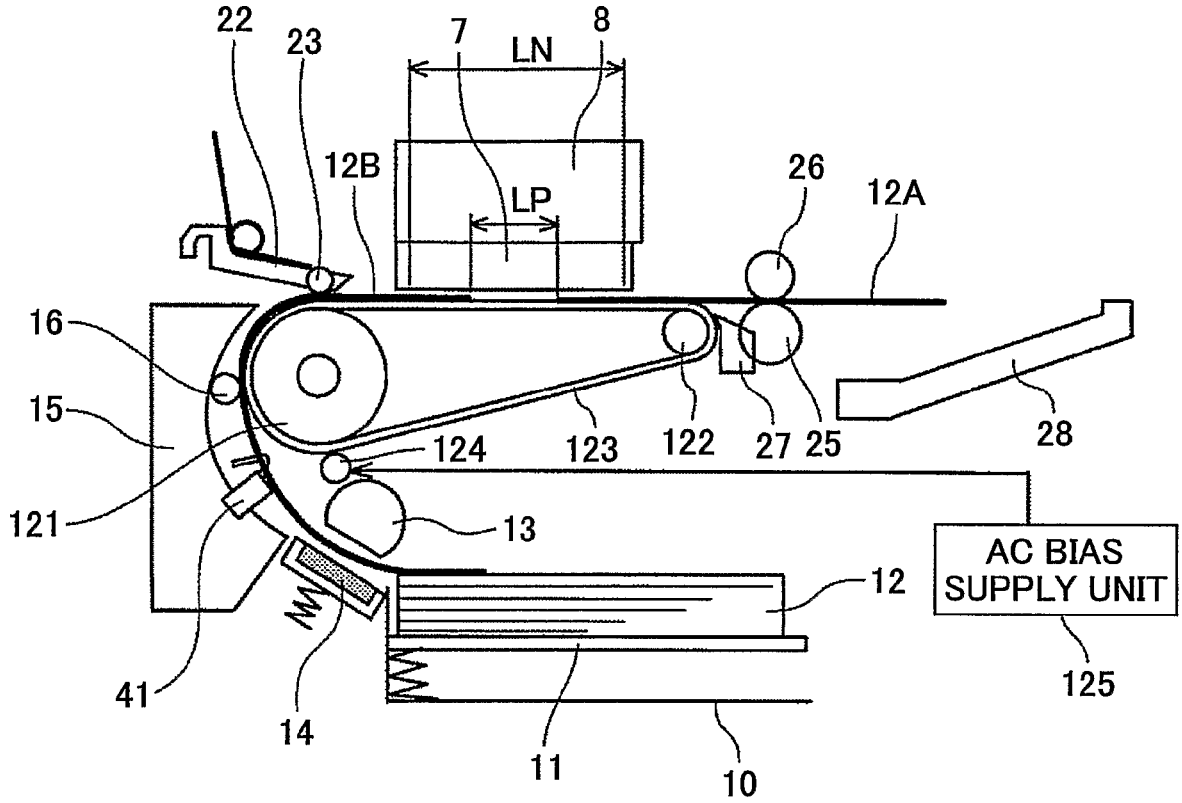
FIG. 9 is a block diagram showing another example of the composition of the image forming device of the invention.
Figure 10:
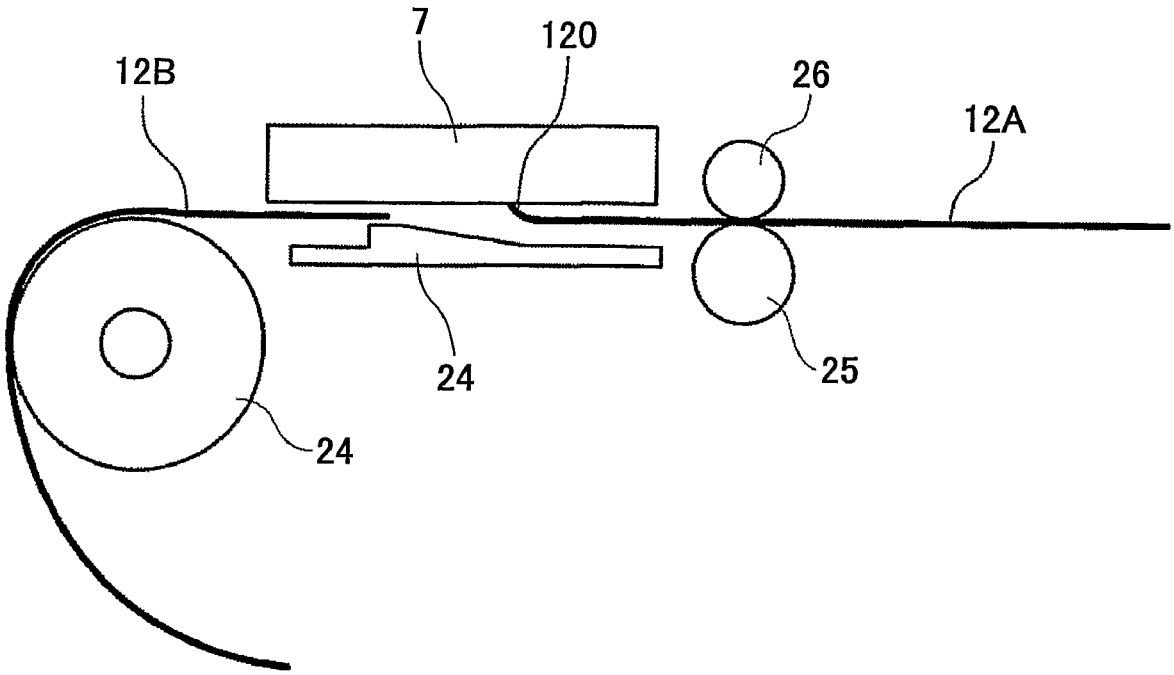
FIG. 10 is a diagram for explaining a curling of the sheet when the electrostatic transport belt of the image forming device is not used.

Next, an example in which the transport belt in the above-mentioned image forming device is replaced by the electrostatic transport belt will be explained with reference to FIG. 9 through FIG. 11.

In order to suck the sheet 12 by the electrostatic force and transport the sheet 12, the image forming device of this embodiment comprises the transport belt 123 which is wound between the transport roller (driving roller) 121 and the tension roller (driven roller) 122 to which energization is performed by the spring (not illustrated), the charging roller 124 which charges the transport belt 123 (electric charge is formed), and the AC bias supply unit 125 which supplies the AC bias to the charging roller 124.

The sheet can be transported with high precision by having the transport belt which sucks the sheet by the electrostatic force and transport the sheet as the sheet carrying means. Namely, in the sheet transport mechanism which transports the sheet by the roller feeding in the previously described embodiment, as shown in FIG. 10, the rear edge 120 of the sheet 12 (the preceding sheet 12A) may be curved by image formation and a curling of the sheet may occur.

Although the amount of bending backward in the rear edge 120 of the sheet according to the kind of the sheet 12 and the image formed on the sheet 12, such curvature may arise because the image formation is performed in the range where there is no roller which presses down the rear edge 120 of the sheet 12.

Figure 11:
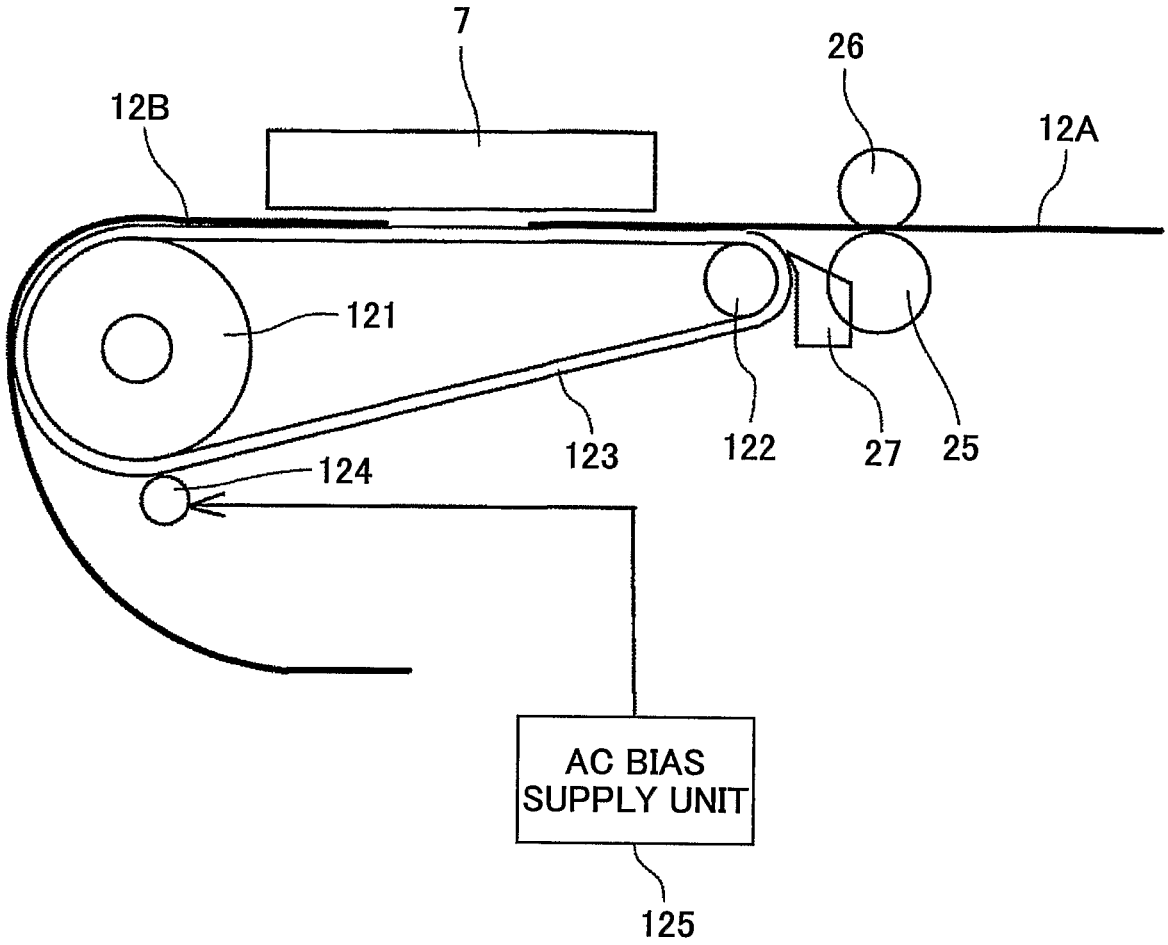
FIG. 11 is a diagram for explaining a sheet transporting state when the electrostatic transport belt of the image forming device is used.

On the other hand, in the image forming device of this embodiment, by sticking the sheet 12 to the transport belt 123 by the electrostatic sucking power and transporting the sheet 12 as shown in FIG. 11, the curvature of the rear edge 120 of the sheet 12 can be prevented, and a high quality image can be formed.

Next, a description will be given of the image forming device in another embodiment of the invention with reference to FIG. 12.

Figure 12:
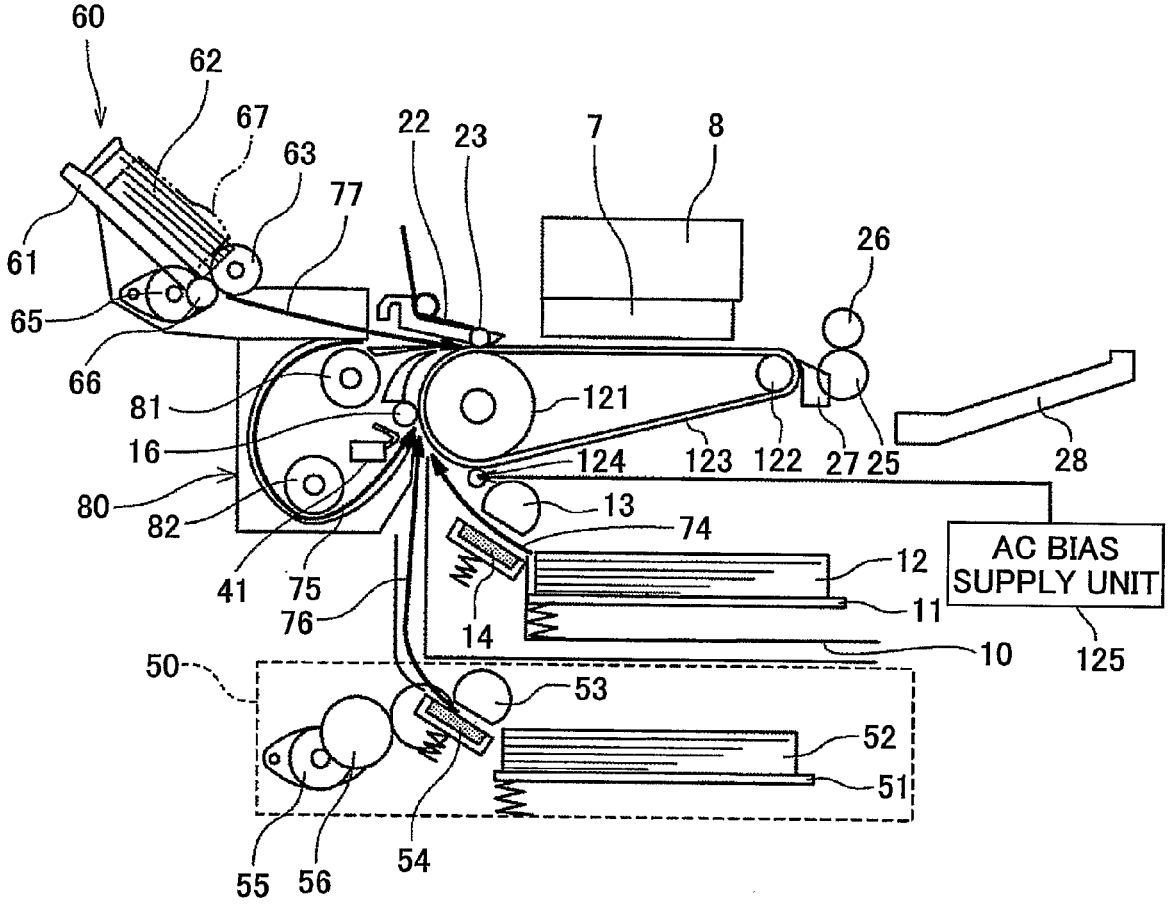
FIG. 12 is a diagram showing an example of the composition of an image forming device in another embodiment of the invention.
Figure 13:
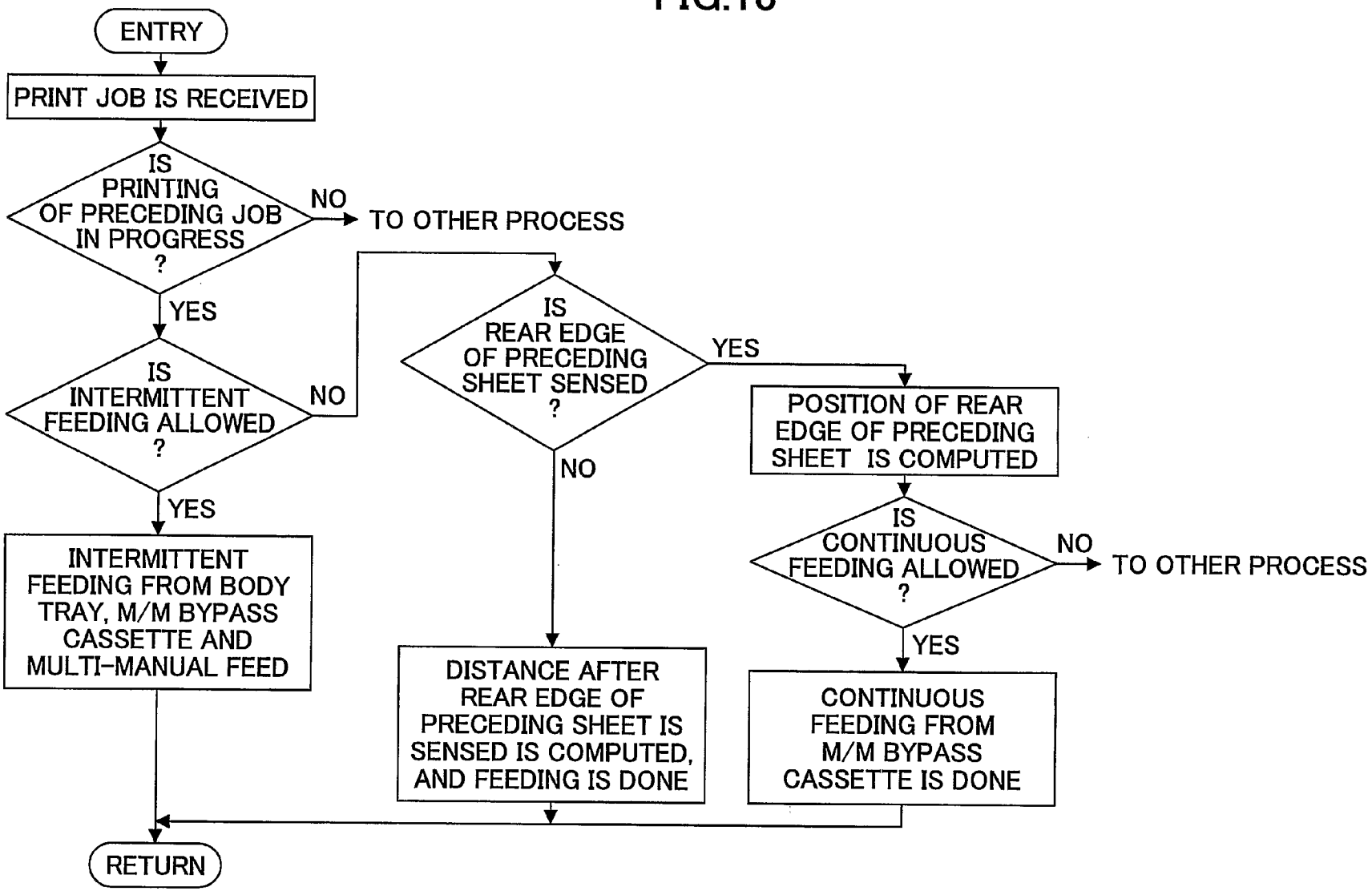
FIG. 13 is a flowchart for explaining the sheet feed control of the image forming device when the print job of the following sheet is received during printing of the print job of the preceding sheet.

As shown in FIG. 12, in this embodiment, an extension cassette 50 which can be connected to the image forming device is provided. The extension cassette 50 comprises the feed roller 53 which carries out separation feeding of every one of the sheets 52 loaded on the paper pressurization board 51 for feeding, the separating pad 54 which is opposed to the feed roller 53 and energization is performed to the side of the feed roller 53, the motor (drive source) 55 for rotating the feed roller 53, and the driving force transmission mechanism 56 for transmitting the rotation of the motor 55 to the feed roller 53. The sheet 52, which is separated from the sheets in the extension cassette 50 and fed by the feed roller 53, is sent to the area the registration roller 16 and the transport belt 123.

A multi-manual bypass tray 60 which can be connected to the image forming device is provided. The multi-manual bypass tray 60 comprises the feed roller 63 to which the multi-manual bypass tray 60 feeds at a time one of the sheets 62 loaded to the multi-manual bypass path 61, the motor (the drive source) 65 for rotating the feed roller 63, the side fence 67 which regulates the side of the sheet 52 on the multi-manual bypass tray 61, and the driving force transmission mechanism 66 for transmitting the rotation of the motor 65 to the feed roller 63.

The sheet 62 which is fed by the feed roller 63 from the multi-manual bypass tray 60 is sent to the area between the control roller 23 and the transport belt 123. Thus, the extension cassette 50 and the multi-manual bypass tray 60 which are these feeding means have the drive system (motors 55 and 65) which became independent of the drive system (the sub-scanning motor 31) which drives transport belt 123, the feeding roller 13, etc., and can feed the sheet to the sheets 52 and 62, respectively.

Figure 14:
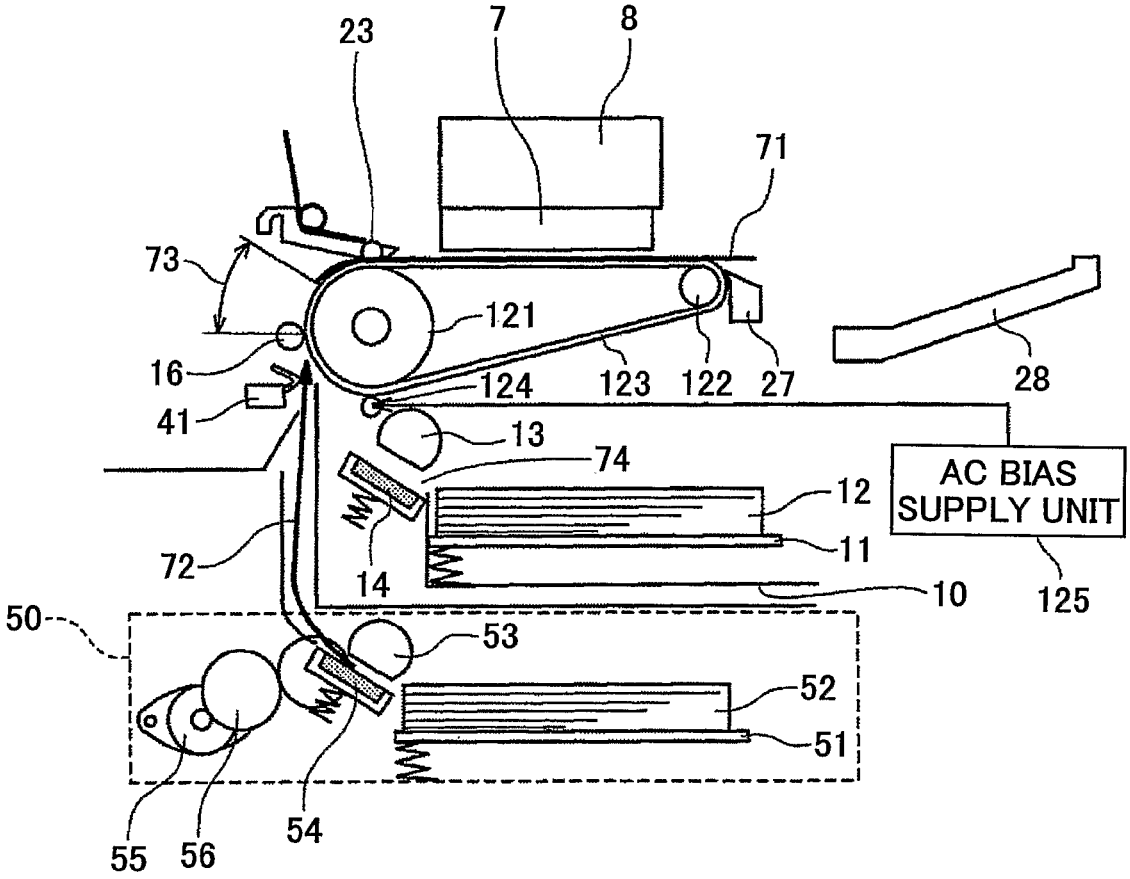
FIG. 14 is a diagram for explaining feeding of the sheet from the extension cassette in the image forming device.

When the print job of the following sheet is received in this image forming device while performing printing by the job to precede as shown in FIG. 14, the remaining time of the image formation of the preceding sheet is calculated, and the time which feeding of the following sheet takes, and the preceding sheet with the sheet presence sensor 41 or paper sensor 42 for paper tip detection.

The rear edge of the preceding sheet is located in the front edge of the sheet feeding tray 11, the extension cassette 50, and the sheets 12, 52, and 62 of the multi-manual bypass tray 60, and below the distance between the sheets to set up from the timing which detected the front edge. Namely, the image formation to the rear edge of the paper of the precedence by the scanning same as intermittent feeding and the front edge of the following sheet is possible and the intermittent feeding.

The sheet is intermittently fed to the sheets 12 and 52 or 62 through the transporting paths 74, 76, and 77 from the sheet feeding tray 11, the extension cassette 50, or the multi-manual bypass tray 60.

On the other hand, if the intermittent feeding is not possible, when the rear edge of the preceding sheet does not exceed the sheet presence sensor 41 (or when the rear edge of the preceding sheet is not yet detection), the processing of the desired distance between the sheets is carried out after the sheet presence sensor 41 detects the rear edge of the preceding sheet, and the timing at which the sheet is fed from the extension cassette 50 or the multi-manual bypass tray 60 is measured. This timing may be measured with the sheet feeding by continuous feeding, irrespective of whether the main part side is during printing by the main scanning.

On the other hand, when the rear edge of the preceding sheet exceeds the sheet presence sensor 41 (or when the rear edge of the preceding sheet is detected), the amount of line feed is computed from the time the rear edge of the preceding sheet passes the sheet presence sensor 41 to the current time. If the continuous feeding using the multi-manual bypass tray 60 is suitable and the setting of the sheet 62 loaded to the multi-manual bypass tray 60 matches with the setting of the sheet (including the size) indicated by the print job concerned, the timing is measured from the multi-manual bypass tray 60 and the continuous feeding is performed.

Figure 15:
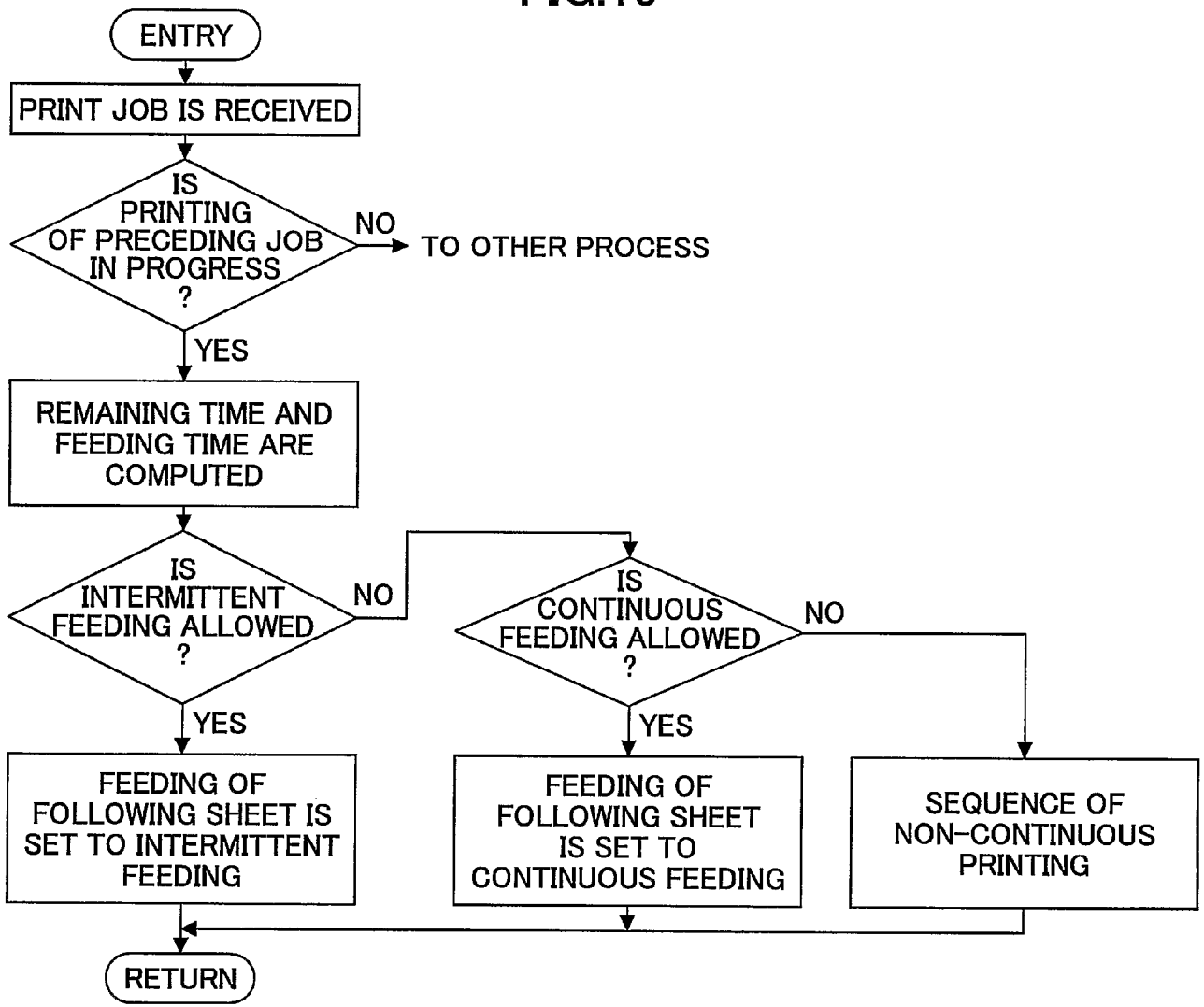
FIG. 15 is a flowchart for explaining the sheet feed control of the image forming device when the print job of the following sheet is received during printing of the print job of the preceding sheet.

The sheet gap when the sheet is fed from the extension cassette 50 will be explained with reference to FIG. 14. After the rear edge of the preceding sheet 71 is detected by the sheet presence sensor 41, the sheet interval 73 between the sheets is set up such that using the motor 55 of the extension cassette 50 to feed the sheet is suited to catch up with the preceding sheet 71, and the sheet 52 is transported through the path 72. The sheet 52 from the extension cassette 50 hits at the registration roller 16, and the sheet gap is changed to the gap 73. Namely, when the print job of the following sheet is received during the printing by the preceding print job, as shown in FIG. 15, the remaining time for the image formation of the preceding sheet and the time for the feeding of the following sheet are calculated. When the given sheet gap between the sheets (or the sheet gap between the sheets with which the image formation to the rear edge of the preceding sheet and the image formation to the front edge of the following sheet can be performed by the same main scanning) can be secured by intermittent feeding, the feeding of the following sheet is set to intermittent feeding. When the given sheet gap between the sheets can be secured by continuation feeding, the feeding of the following sheet is set to continuous feeding. When even continuous feeding cannot secure the desired sheet gap between the sheets, the control is shifted to a non-continuous printing sequence (or the printing sequence in which the image formation to the rear edge of the preceding sheet and the image formation to the front edge of the following sheet are not performed by the same main scanning).

Thus, when the image formation is performed on the plurality of sheets continuously, the image formation to the rear edge of the preceding sheet and the image formation to the front edge of the following sheet are performed by the same main scanning of the carriage. When the printing data to the following sheet is received during the image formation of the print job to the preceding sheet, the feed control of the following sheet is performed based on the remaining time for the image formation to the preceding sheet and the time for the feeding of the following sheet. It is possible to improve the printing speed at the time of continuous printing even when receipt of the print job to the following sheet delays.

In this case, when the separation feeding of the following sheet at the amount of line feed enables the image formation by the same main scanning, the separation feeding by intermittent feeding is performed. When the image formation by the same main scanning is enabled by performing the separation feeding by continuous feeding of the following sheet, the separation feeding by continuous feeding is performed. When the image formation by the same main scanning is not attained by either of intermittent feeding and continuous feeding, the control is shifted to the non-continuous printing sequence in which the image formation is not performed by the same main scanning. It is possible to improve the printing speed by continuous printing as much as possible.

And with the drive system which transports the sheets on which the image is formed intermittently, it has independently a feeding means which can separation feed paper to the sheet by a controllable drive system. Or, by making independently the paper which carries out image formation into the drive system made to transport intermittently by a controllable drive system with the composition which can equip with the feeding means which can separation feed paper to the sheet, even when between the sheets opens by the receipt delay of a print job, between the sheets can be secured in the form where paper is easily fed to the following sheet by continuous transporting, and the following sheet catches up with the preceding sheet, and improvement in the speed of printing speed can be attained.

In the image forming device of FIG. 12, the double-sided unit 80 is attached to the back side of the image forming device. When the double-sided unit 80 is provided with the sheet reversal rollers 81 and 82 and the transport belt 123 is reversed after the print end to one side, the sheet on which the image formation to one side is ended is sent to the double-sided unit 80, the sheet is reversed so that the other side of the sheet is turned to the printing side by the reversal rollers 81 and 82, and the sheet is fed to the area between the registration roller 16 and the transport belt 123.

And when the image formation to one side (the 1st page) of the preceding sheet is performed, the main scanning is performed by the printing head 7 in the state where the sheet is fed to the sheets 12 and 52 or 62, and it is electrostatically sucked by the transport belt 123 from the sheet feeding tray 11, the extension cassette 50, or the multi-manual bypass tray 60, and the image formation is performed.

After the image formation to one side of the sheet is completed, the transport belt 123 is reversed, the sheet is sent to the double-sided unit 80, the sheet reversal is carried out through the transporting path 75, and the sheet is re-fed to the area between the registration roller 16 and the transport belt 123.

The sheet presence sensor 41 is arranged in the position where the sensor 41 can detect the sheet front edge and rear edge in the transporting path 75. The sheet drawing in and re-feeding to the double-sided unit 80 are performed by continuous transporting, not by intermittent transporting.

After detecting the front edge of the sheet being re-fed by the sheet presence sensor 41, the timing for the sheet being fed from the sheet feeding tray 11, the extension cassette 50, or the multi-manual bypass tray 60 is adjusted, and the sheet gap is set up to the desired value.

In order to raise the accuracy of the sheet gap, it is necessary to temporarily stop, after the detection of the sheet rear edge by the sheet presence sensor 41, the sheet in the state where the sheet is transported to the position between the registration roller 16 and the transport belt 123, so that the sheet may be fed from the extension cassette 50 or the multi-manual bypass tray 60. If the sheet is fed from the extension cassette 50, the sheet gap 73 is set up as shown in FIG. 11.

Thus, the image forming device of this embodiment has the transport path which reverses and transports the sheet after the end of image formation to one side of the sheet, and has the composition which makes the sheet gap between the preceding sheet and the following sheet allow the image formation by the same main scanning at the time of the image formation to the other side of the sheet through. It is possible to shorten the sheet gap between the sheets also at the time of double-sided printing, and improve the speed of double-sided printing.

In the foregoing description, the embodiment in which the present invention is applied to the image forming device having the printer composition has been explained. Similarly, the image forming device of the invention is applicable to a multi-function peripheral device having multiple functions of printer/fax/copier.

The present invention is not limited to the above-described embodiments and variations and modifications may be made without departing from the scope of the invention.

Further, the present application is based on and claims the benefit of priority of Japanese patent application No. 2005-046497, filed on Feb. 23, 2005, and Japanese patent application No. 2005-366024, filed on Dec. 20, 2005, the entire contents of which are hereby incorporated by reference.

The invention claimed is:

1. An image forming device comprising a carriage on which a printing head is carried, the printing head having a nozzle sequence in which a plurality of nozzles each of which discharges a droplet of printing liquid are arrayed, the image forming device performing a main scanning of the carriage to a sheet and feeding the sheet intermittently in a direction perpendicular to a main scanning direction, so that an image is formed on the sheet, wherein, when a continuous printing of images to a plurality of sheets is performed and a quality level of an image formed on a following sheet is the same as a quality level of an image formed on a preceding sheet, the image formation to both a rear edge of the preceding sheet and a front edge of the following sheet is performed by a same main scanning of the carriage, and wherein, when the quality level of the image formed on the following sheet differs from the quality level of the image formed on the preceding sheet, the image formation to the following sheet is performed after the image formation to the rear edge of the preceding sheet is performed completely.

2. The image forming device according to claim 1 wherein the image on the preceding sheet and the image on the following sheet are separately formed by respective print jobs.

3. The image forming device according to claim 1 wherein the image forming device comprises a sheet feeding unit which is capable of separating and feeding a sheet and driven by a drive system that is controllable independently from a drive system which feeds intermittently the sheet when the main scanning of the carriage is performed.

4. The image forming device according to claim 1 wherein a sheet feeding unit which is capable of separating and feeding a sheet and driven by a drive system that is controllable independently from a drive system which feeds intermittently the sheet when the main scanning of the carriage is performed is attachable to the image forming device.

5. The image forming device according to claim 1 wherein the image forming device comprises a transport path for transporting a sheet which is reversed after the image formation to one side of the sheet is completed, and a distance between the preceding sheet and the following sheet along the transport path is set up, during the image formation to the other side of the sheet, to allow the image formation to the rear edge of the preceding sheet and the front edge of the following sheet to be performed by the same main scanning of the carriage.

6. The image forming device according to claim 1 wherein the image forming device comprises an electrostatic transport belt which adsorbs and transports the sheet by an electrostatic force.

7. An image forming device comprising a carriage on which a printing head is carried, the printing head having a nozzle sequence in which a plurality of nozzles each of which discharges a droplet of printing liquid are arrayed, the image forming device performing a main scanning of the carriage to a sheet and feeding the sheet intermittently in a direction perpendicular to a main scanning direction, so that an image is formed on the sheet, wherein, when a continuous printing of images to a plurality of sheets is performed and a quality level of an image formed on a following sheet is the same as a quality level of an image formed on a preceding sheet, the image formation to both a rear edge of the preceding sheet and a front edge of the following sheet is performed by a same main scanning of the carriage, and wherein, when the quality level of the image formed on the following sheet differs from the quality level of the image formed on the preceding sheet, the image formation is performed with a main scanning speed and an amount of sheet feeding which are suited to the image of a higher quality level.

8. The image forming device according to claim 7 wherein, when the quality level of the image formed on the preceding sheet is higher than the quality level of the image formed on the following sheet, the image formation to the front edge of the following sheet is performed by skipping dots and performing the main scanning of the carriage with a main scanning speed suited to the quality level of the image formed on the preceding sheet, and, after the image formation to the preceding sheet is completed, the image formation is performed with a main scanning speed and an amount of sheet feeding which are suited to the quality level of the image formed on the following sheet.

9. The image forming device according to claim 7 wherein, when the quality level of the image formed on the preceding sheet is lower than the quality level of the image formed on the following sheet, the image formation to the rear edge of the preceding sheet is performed by skipping dots and performing the main scanning of the carriage with a main scanning speed suited to the quality level of the image formed on the following sheet.

10. An image forming device comprising a carriage on which a printing head is carried, the printing head having a nozzle sequence in which a plurality of nozzles each of which discharges a droplet of printing liquid are arrayed, the image forming device performing a main scanning of the carriage to a sheet and feeding the sheet intermittently in a direction perpendicular to a main scanning direction, so that an image is formed on the sheet, wherein, when a continuous printing of images to a plurality of sheets is performed, the image formation to both a rear edge of the preceding sheet and a front edge of the following sheet is performed by a same main scanning of the carriage, and wherein, when printing data to the following sheet is received during image formation of a print job to the preceding sheet, a feeding control of the following sheet is performed based a remaining time for the image formation to the preceding sheet and a time for feeding of the following sheet.

11. The image forming device according to claim 10 wherein, when the image formation to the preceding sheet and the following sheet by the same main scanning is allowed by performing separation feeding of the following sheet for every amount of line feed, separation feeding of the following sheet is performed by intermittent feeding, and when the image formation to the preceding sheet and the following sheet by the same main scanning is allowed by performing separation feeding of the following sheet by continuous feeding, separation feeding of the following sheet is performed by continuous feeding, and when the image formation to the preceding sheet and the following sheet by the same main scanning is not allowed by intermittent feeding or continuous feed, the image formation to the preceding sheet and the following sheet by the same main scanning is not performed.

* * * * *